US007300046B2

(12) United States Patent
Sugiyama et al.

(10) Patent No.: US 7,300,046 B2
(45) Date of Patent: Nov. 27, 2007

(54) SHEET PROCESSING APPARATUS AND IMAGE FORMING APPARATUS HAVING THE SAME

(75) Inventors: Akihiko Sugiyama, Abiko (JP); Naoto Saeki, Abiko (JP); Takehiko Kodama, Toride (JP); Naoyasu Funada, Moriya (JP); Hiroshi Suzuki, Toride (JP)

(73) Assignee: Canon Finetech Inc., Joso-Shi (JP)

( * ) Notice: Subject to any disclaimer, the term of this patent is extended or adjusted under 35 U.S.C. 154(b) by 0 days.

(21) Appl. No.: 11/103,589

(22) Filed: Apr. 12, 2005

(65) Prior Publication Data

US 2005/0230898 A1 Oct. 20, 2005

(30) Foreign Application Priority Data

Apr. 16, 2004 (JP) ..... 2004-122291
Apr. 16, 2004 (JP) ..... 2004-122292
Apr. 16, 2004 (JP) ..... 2004-122293
Apr. 19, 2004 (JP) ..... 2004-123555

(51) Int. Cl.
*B65H 37/04* (2006.01)

(52) U.S. Cl. ..... 270/58.17; 270/58.01; 270/58.08; 270/58.27; 271/249; 271/250

(58) Field of Classification Search ..... 270/58.17, 270/58.01, 58.08, 58.27; 271/249, 250
See application file for complete search history.

(56) References Cited

U.S. PATENT DOCUMENTS 5,084,736 A 1/1992 Suzuki et al. ..... 355/271
5,168,290 A 12/1992 Tanaka et al. ..... 346/134
5,239,347 A 8/1993 Onodera et al. ..... 355/274
5,273,274 A 12/1993 Thomson et al. ..... 271/228
5,321,486 A 6/1994 Nanbu et al. ..... 355/311
5,335,904 A 8/1994 Ryuzaki ..... 271/272
5,543,908 A 8/1996 Suzuki ..... 355/315
5,555,082 A 9/1996 Tanaka et al. ..... 355/309
5,590,871 A * 1/1997 Okabe et al. ..... 270/58.27
5,622,359 A * 4/1997 Kawano et al. ..... 270/58.12
5,676,363 A 10/1997 Kishida et al. ..... 271/10.01
5,738,453 A 4/1998 Tsuburaya et al. ..... 300/624
5,938,186 A 8/1999 Sato et al. ..... 270/58.11

(Continued)

FOREIGN PATENT DOCUMENTS

JP 7-257811 10/1995

(Continued)

*Primary Examiner*—Gene O. Crawford
*Assistant Examiner*—Leslie A Nicholson, III
(74) *Attorney, Agent, or Firm*—Fitzpatrick, Cella, Harper & Scinto

(57) ABSTRACT

A sheet processing apparatus including a first sheet stacking portion for stacking sheets thereon, a second sheet stacking portion provided downstream of the first sheet stacking portion with respect to a sheet conveying direction, a sheet holding device for holding the sheets stacked on the first sheet stacking portion, and a holding device moving device for moving the sheet holding device between a holding position for holding the sheets and a discharging position provided downstream of the holding position in the sheet conveying direction, wherein the discharging position has a predetermined distance upstream from a stop position in which the sheet holding device moved to a downstream side with respect to the sheet conveying direction by the holding device moving device is stopped to an upstream side.

16 Claims, 30 Drawing Sheets

U.S. PATENT DOCUMENTS

| | | | | |
|---|---|---|---|---|
| 5,951,000 | A | 9/1999 | Sato et al. | 270/58.11 |
| 6,168,154 | B1 | 1/2001 | Asahara et al. | 271/245 |
| 6,273,418 | B1 * | 8/2001 | Fujikura et al. | 271/228 |
| 6,357,736 | B1 * | 3/2002 | Kubota et al. | 270/58.08 |
| 6,427,997 | B1 | 8/2002 | Hirota et al. | 270/58.12 |
| 6,473,196 | B2 | 10/2002 | Usami et al. | 358/1.18 |
| 6,561,503 | B1 * | 5/2003 | Ogata et al. | 270/58.12 |
| 6,601,846 | B2 * | 8/2003 | Saito et al. | 271/226 |
| 6,705,603 | B1 * | 3/2004 | Kirino et al. | 270/12 |
| 6,819,906 | B1 * | 11/2004 | Herrmann et al. | 399/368 |
| 7,192,020 | B2 * | 3/2007 | Hayashi et al. | 270/58.11 |
| 2003/0219294 | A1 * | 11/2003 | Yoshimura et al. | 399/408 |
| 2004/0173960 | A1 | 9/2004 | Oikawa et al. | 271/208 |
| 2004/0181308 | A1 * | 9/2004 | Hayashi et al. | 700/223 |
| 2004/0188911 | A1 * | 9/2004 | McNamara et al. | 270/58.08 |
| 2005/0121848 | A1 | 6/2005 | Kodama et al. | 270/58.12 |

FOREIGN PATENT DOCUMENTS

| | | | |
|---|---|---|---|
| JP | 11-322160 | | 11/1999 |
| JP | 2002-37512 | | 2/2002 |
| JP | 2002-274734 | | 9/2002 |
| JP | 2002-284425 | | 10/2002 |
| JP | 2003081517 | A * | 3/2003 |

* cited by examiner

SHEET PROCESSING APPARATUS AND IMAGE FORMING APPARATUS HAVING THE SAME

This application claims priority benefits of Japanese Patent Application Nos. 2004-122291 filed Apr. 16, 2004, and 2004-122292 filed Apr. 16, 2004, and 2004-122293 filed Apr. 16, 2004, and 2004-123555 filed Apr. 19, 2004, the entire disclosures of which are hereby incorporated herein by reference in their entirety.

BACKGROUND OF THE INVENTION

1. Field of the Invention

This invention relates to a sheet processing apparatus and an image forming apparatus provided with the same.

2. Description of the Related Art

Heretofore, some of image forming apparatuses such as a copying machine, a printer, a laser printer and a facsimile, and a compound apparatus of these have been designed such that an image forming apparatus main body is provided with a sheet processing apparatus for effecting such treatment as a stapling treatment on sheets discharged from the image forming apparatus main body.

As such a sheet processing apparatus, there is one designed such that sheets discharged from the image forming apparatus main body are conveyed to a sheet processing portion, and such treatments as a sheet stacking and aligning operation of stacking and aligning the discharged sheets, and a stapling operation of stapling the sheets are performed in the sheet processing portion.

Further, such a sheet processing apparatus is designed such that as shown, for example, in FIG. 1 of the accompanying drawings, after the treatments have been effected on the sheets, a sheet bundle is discharged from a treatment tray 602 to the inclined stack tray 601 of a main body external portion 600 by bundle discharging means 650, and in this case, the sheet bundle can be aligned in one direction from gravity by the inclination of the stack tray 601 (see Japanese Patent Application Laid-open No. 2002-284425).

As another sheet processing apparatus, there is known an apparatus designed such that sheets having images formed thereon are contained in stacking means, whereafter a sheet bundle is bundle-moved, whereafter such a treatment as a stapling treatment is effected on the sheet bundle, and thereafter the sheet bundle is again bundle-moved and contained in the stacking means (see Japanese Patent Application Laid-open No. H07-257811)

However, in such a conventional sheet processing apparatus and an image forming apparatus provided with the same, when the sheet bundle is to be stacked on the inclined stack tray 601, the sheet bundle can be aligned by the inclination of the stack tray 601, but when the sheet bundle is to be discharged to a substantially horizontal stack tray, the alignment of the sheet bundle by the gravity fall thereof cannot be effected. Therefore, depending on an inertial force or the condition of the sheet bundle, the position of the sheet bundle stacked on the stack tray after it has been discharged does not become constant, and the stacking property is reduced.

Particularly, in the case of an unstapled sheet bundle, the alignment in the sheet bundle is liable to deviate, and once it deviates, it is impossible to align the sheet bundle again. That is, in a case where the sheet bundle is discharged to the substantially horizontal stack tray, it has been difficult to stack the sheet bundle in its aligned state.

Also, when the treatment of the sheet bundle is to be effected in the afore described another conventional sheet processing apparatus, there is a case where sheets are discharged from a discharge path onto the treatment tray, so as to fly, and the discharged sheets are moved in a direction opposite to the discharging direction, and then the aligning operation is performed, whereafter the edge portions of the sheets in the conveying direction thereof are aligned, and then a sheet bundle is stapled (see Japanese Patent Application Laid-open No. 2002-37512).

In order to perform such an aligning operation, the sheet processing apparatus, as shown, for example, in FIG. 2 of the accompanying drawings, has a resilient member 671 called a paddle, and an aligning belt 619 rotated in synchronism with a discharge roller 617 for discharging a sheet S onto a treatment tray 672, and the trailing edge of the sheet S is pulled back to the nip point between the aligning belt 619 and the treatment tray 672 by the resilient member (paddle) 671, whereafter the sheet S is caused to abut against an alignment abutting member (not shown) by the frictional force of the aligning belt 619 to thereby regulate the position of the sheet in the conveying direction thereof and perform alignment.

Also, the sheet discharged onto the treatment tray and caused to abut against the alignment abutting member and having had its edge portion in the conveying direction aligned is thereafter subjected to such an aligning operation that it is nipped in its width direction by a width direction aligning member movable in the width direction orthogonal to the conveying direction, so that the position of the sheet in the width direction may be regulated.

Now, in the conventional sheet processing apparatus shown in FIG. 2 and an image forming apparatus provided with the same, to convey and align the sheets, several parts such as the discharge roller 617, the resilient member 671 and the aligning belt 619 are necessary, and this has led to a great number of parts including members around those parts.

Also, in a case where a frictional force obtained by the rotation of the resilient member 671 is utilized to effect the alignment of the sheets S in the conveying direction thereof, as the number of stacked sheets S increases, the amount of flexure of the resilient member 671 becomes greater, and along therewith, the contact pressure of the resilient member 671 with the sheet S increases, and when the sheet S abuts against the abutting portion, there has been the possibility of the sheet S being buckled. When in order to effect the alignment of the sheet S in the conveying direction thereof, a frictional force obtained by the rotation of the aligning belt is utilized as another means, there has been the possibility that deviation is caused to an aligned sheet bundle by the delicate vibration of the aligning belt occurring during the rotation of the aligning belt.

Further, the sheet S is discharged onto the treatment tray by the discharge roller 617 so as to fly and therefore, when the sheet S is discharged onto the treatment tray, the falling position of the sheet is not stable in some cases depending on the kind of the sheet S, and in such cases, it has sometimes been impossible to cause the discharged sheet to stably abut against the aligning and abutting portion.

Also, in a case where design is made such that the alignment of the sheet S in the width direction thereof is effected by a width direction aligning member, if a change occurs to the length of the sheet in the width direction thereof due to the influence of temperature, humidity or the like, the sheet may sometimes be buckled by this change in the length. On the supposition of such a change in the length of the sheet in the width direction thereof, it is also possible, for example, to adopt a construction in which a spring or the like is attached to the width direction aligning member to thereby enable the change in the length in the width direction to be absorbed to some extent, but the adoption of such a construction leads to a greater number of parts.

Further, in the conventional sheet processing apparatus, when the sheet is to be uniformized (aligned) in the width (a direction intersecting with the sheet conveying direction), as shown in FIG. 3 of the accompanying drawings, the sheet S conveyed to a treatment tray 800 in the direction indicated by the arrow A has been caused to abut against an abutting wall 803 with a width regulating plate 802 moved on the treatment tray 800 by a predetermined amount in the direction indicated by the arrow B orthogonal to the sheet conveying direction. The width regulating plate 802 is adapted to receive the driving force of a motor (not shown) through a rack and a pinion and be moved thereby. The width of the sheet being aligned also means that one side edge (hereinafter referred to as the side edge) Sa of the sheet S is aligned.

The amount of movement of the width regulating plate 802 is set to a distance of e.g. about 2 mm to about 3 mm further inwardly from a position at which the side edge Sa of the sheet S along the sheet conveying direction has abutted against the abutting wall 803. That is, the width regulating plate 802 is adapted to be moved to a position made narrower by about 2 mm to about 3 mm than the width size (a length C in FIG. 3) of each sheet.

However, in the conventional sheet processing apparatus provided with the width regulating plate 802, the amount of movement of the width regulating plate 802 is determined to about 2 mm to about 3 mm further from the position at which the side edge Sa of the sheet S has been caused to abut against the abutting wall 803, and this has led to the problem that in the case of an upper trough curl in which the opposite side edges of the sheet S face up, or a lower trough curl in which the opposite side edges of the sheet S face down, the width C of the sheet becomes narrower by the amount of curl of the sheet S than the actual width of the sheet, and the sheet cannot be caused to reliably abut against the abutting wall 803 by the predetermined width narrowing amount of the width regulating plate 802, and width aligning accuracy is remarkably lowered.

If the amount of movement of the width regulating plate 802 is made greater than about 2 mm to about 3 mm, when an uncurled normal sheet is pushed in, an overload is applied to a motor for moving the width regulating plate and the motor may lose synchronism. Therefore, the conventional sheet processing apparatus is designed such that the sheet is pushed in by the width regulating plate 802 by such a degree of distance (about 2 mm to about 3 mm) that the motor does not lose synchronism.

Also, when the sheet has come into contact with the width regulating plate 802, if the sheet is in an upper trough curled state, the sheet may more or less float up from the treatment tray 800 along the curl, and if conversely the sheet is in a lower trough curled state, the sheet may more or less float up from the treatment tray 800 in such a manner as to be turned up along the curl, and this has led to the problem that the width aligning accuracy is remarkably lowered.

Also, in the conventional sheet processing apparatus, the entire side edge of the sheet is pushed by the width regulating plate 802, and this has also led to the problem that if the size of the sheet during the cutting thereof is uneven, the width aligning accuracy cannot be enhanced.

SUMMARY OF THE INVENTION

So, the present invention has been made in view of such circumstances and an object thereof is to provide a sheet processing apparatus which can improve the stackability of sheet by a simple construction, and an image forming apparatus provided with the same.

An embodiment of the present invention has as its object to provide a sheet processing apparatus which can prevent the positional deviation of a sheet bundle discharged after treated, and an image forming apparatus provided with the same.

Also, an embodiment of the present invention has as its object to provide a sheet processing apparatus which can stably align the position of a sheet in a sheet conveying direction by a simple construction, and an image forming apparatus provided with the same.

Also, an embodiment of the present invention has as its object to provide a sheet processing apparatus which can align the position of a sheet to be treated in the width direction thereof orthogonal to a sheet conveying direction, and an image forming apparatus provided with the same.

Also, an embodiment of the present invention has as its object to provide a sheet processing apparatus which can reliably effect the alignment of the side edge of a sheet along a sheet conveying direction, and an image forming apparatus provided with the same.

Also, an embodiment of the present invention has as an object thereof to provide a sheet processing apparatus which is improved in the aligning accuracy of the side edge of a sheet.

The present invention has as its object to provide a sheet processing apparatus provided with first sheet stacking means for stacking sheets thereon, second sheet stacking means provided downstream of the first sheet stacking means with respect to a sheet conveying direction, sheet holding means for holding the sheets stacked on the first sheet stacking means, and holding means moving means for moving the sheet holding means between a holding position for holding the sheets and a discharging position provided downstream of the holding position with respect to the sheet conveying direction, wherein the discharging position has a predetermined distance toward an upstream side from a stop position at which the sheet holding means moved to the downstream side with respect to the sheet conveying direction by the holding means moving means, and an image forming apparatus having the sheet processing apparatus.

Also, the present invention has as an object thereof to provide a sheet processing apparatus provided with sheet stacking means for stacking sheets thereon, a regulating member provided upstream of the sheet stacking means with respect to a sheet conveying direction for regulating the sheets stacked on the sheet stacking means in the sheet conveying direction, sheet conveying means making forward rotation for conveying the sheets on the sheet stacking means in the sheet conveying direction, and reverse rotation for conveying the sheets on the sheet stacking means in a direction reverse to the sheet conveying direction, and controlling means for effecting the reverse rotation of the sheet conveying means after the forward rotation of the sheet conveying means to thereby cause the sheets to abut against the regulating member, and thereafter further effecting the reverse rotation of the sheet conveying means for a predetermined time, and an image forming apparatus having the sheet processing apparatus.

Also, the present invention has as an object thereof to provide a sheet processing apparatus provided with sheet stacking means for stacking sheets thereon, a side edge regulating member provided on a side of the sheet stacking means in a width direction for regulating the sheets stacked on the sheet stacking means in the width direction intersecting with a sheet conveying direction, sheet moving means for moving each time a sheet is conveyed onto the sheet stacking means, the sheet in the width direction to thereby cause the sheet to abut against the side edge regulating member, and controlling means for further performing the operation of moving the sheet in the width direction by the sheet moving means for a predetermined time, and an image forming apparatus having the sheet processing apparatus.

Also, the present invention has as an object thereof to provide a sheet processing apparatus provided with sheet stacking means for stacking sheets thereon, a side edge regulating member provided on a side of the sheet stacking means in a width direction for regulating the sheets stacked on the sheet stacking means in the width direction intersecting with a sheet conveying direction, sheet moving means for moving the sheets stacked on the sheet stacking means to thereby cause the sheets to abut against the side edge regulating member, and pressing means provided near the side edge regulating member for movement toward and away from the sheet stacking means for pressing a side edge portion of the sheets abutting against the side edge regulating member against the sheet stacking means, wherein the pressing means has a guide surface for receiving the side edge portion of the sheets being moved between the pressing means and the sheet stacking means by the sheet moving means, and an image forming apparatus having the sheet processing apparatus.

These and other objects, features and advantages of the present invention will become more apparent upon consideration of the following description of the preferred embodiments of the present invention taken in conjunction with the accompanying drawings.

BRIEF DESCRIPTION OF THE DRAWINGS

FIG. 22A is a view when the width of the sheet is narrow. FIG. 22B is a view when the width of the sheet is greater than that shown in FIG. 22A. FIG. 22C is a view when the width of the sheet is greater than that shown in FIG. 22B.

FIG. 23A is a view when the width of the sheet is narrow. FIG. 23B is a view when the width of the sheet is greater than the width of the sheet shown in FIG. 23A. FIG. 23C is a view when the width of the sheet is greater than the width of the sheet shown in FIG. 23B.

FIG. 24A is a view in which the offset roller is conveying the sheet to a downstream side. FIG. 24B is a view in which the offset roller is conveying the sheet toward a sheet trailing edge stopper after the offset roller has conveyed the sheet to a predetermined position on the downstream side. FIG. 24C is a view in which the offset roller is conveying the sheet toward a side edge positioning wall.

FIG. 25A is a view showing a state in which the offset roller is spaced apart from the sheet after it has rammed the sheet against the side edge positioning wall. FIG. 25B is a view showing a state in which the offset roller is returned to its standby position.

FIG. 26A is a view showing the position of the sheet clamp member when the offset roller rams the sheet against the sheet trailing edge stopper. FIG. 26B is a view showing the position of the sheet clamp member when the offset roller rams the sheet against the side edge positioning wall.

FIG. 31A is a view in which the offset roller is conveying the sheet to the downstream side. FIG. 31B is a view in which the offset roller is conveying the sheet toward a sheet trailing edge stopper after it has conveyed the sheet to a predetermined position on the downstream side. FIG. 31C is a view in which the offset roller is conveying the sheet toward a side edge positioning wall.

FIG. 32A is a view showing the state in which the offset roller is spaced apart from the sheet after it has rammed the sheet against the side edge positioning wall. FIG. 32B is a view showing a state in which the offset roller is returned to its standby position.

FIG. 33A is a view showing the position of the sheet clamp member when the offset roller rams the sheet against the sheet trailing edge stopper. FIG. 33B is a view showing the position of the sheet clamp member when the offset roller rams the sheet against a side edge positioning wall.

DESCRIPTION OF THE PREFERRED EMBODIMENTS

The preferred embodiments for carrying out the present invention will hereinafter be described in detail with reference to the drawings.

Figure 1:
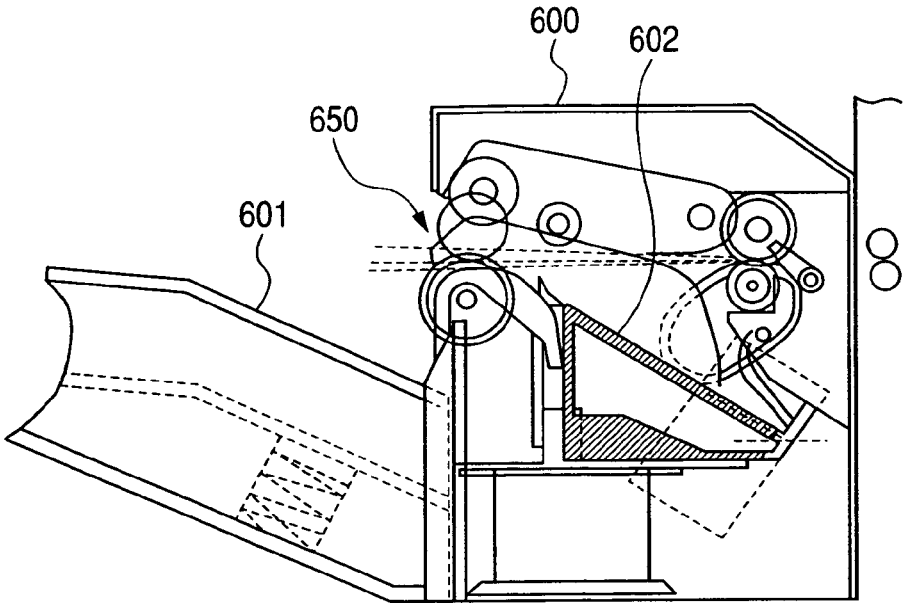
FIG. 1 illustrates the construction of a conventional sheet processing apparatus.
Figure 2:
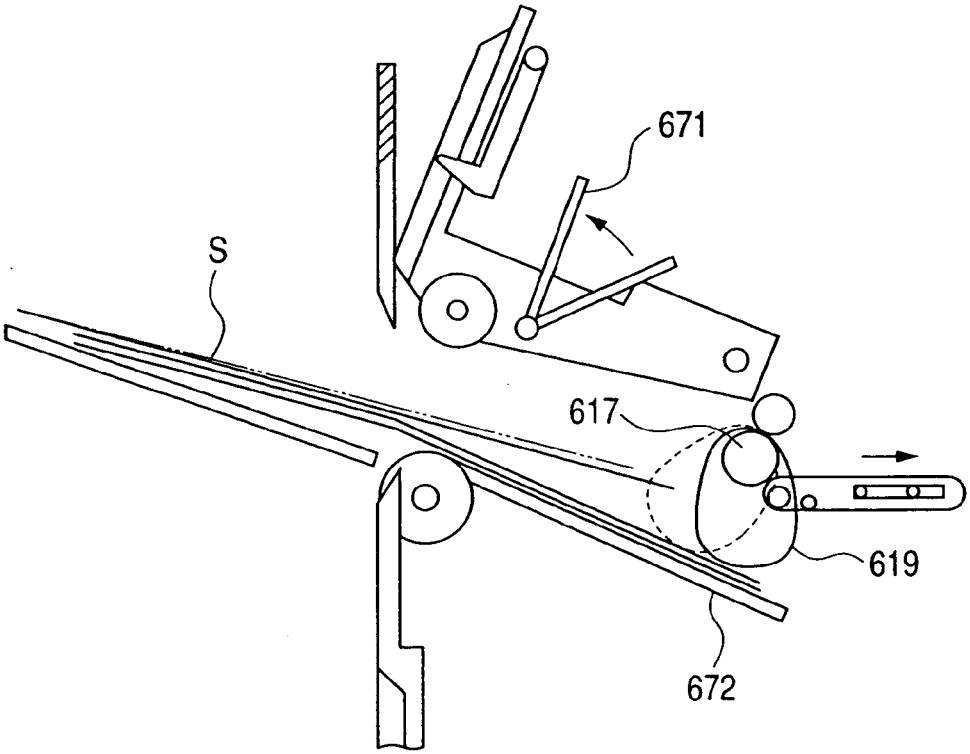
FIG. 2 illustrates the construction of another conventional sheet processing apparatus.
Figure 3:
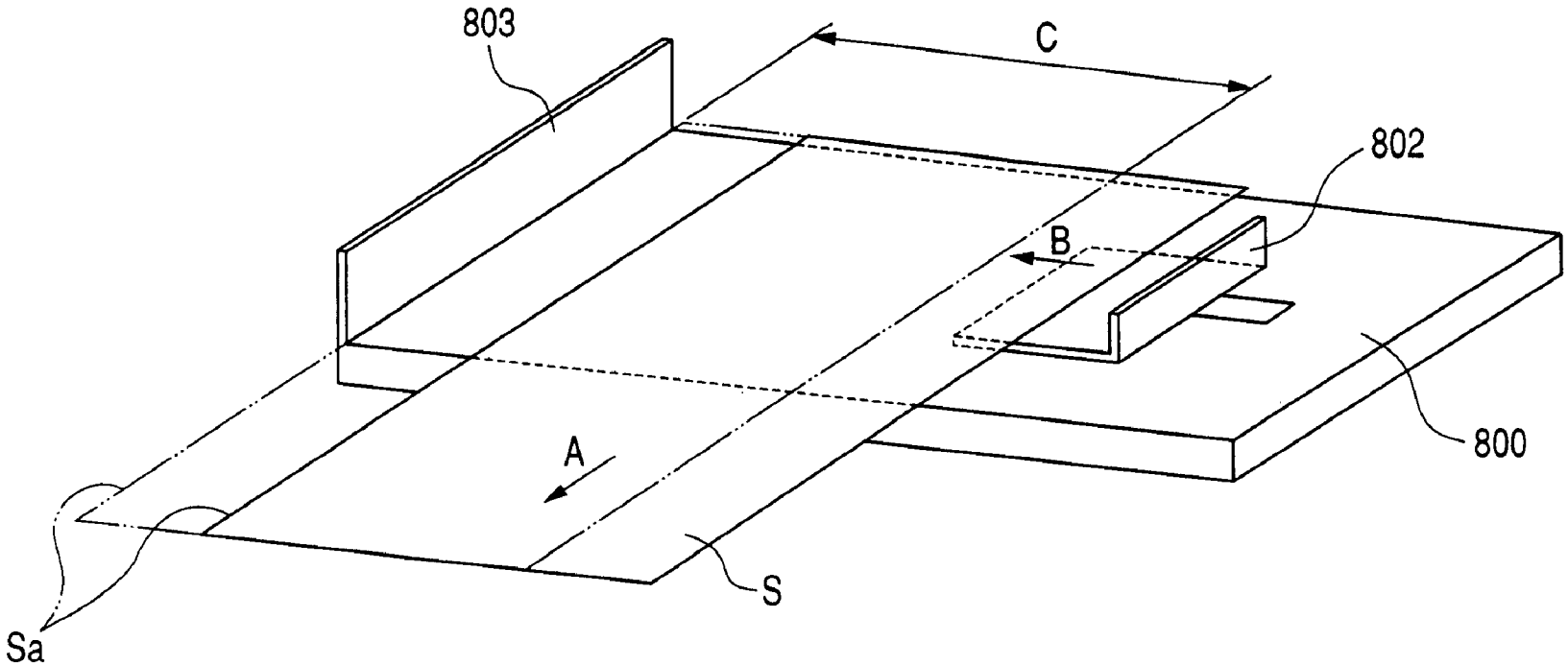
FIG. 3 is a schematic perspective view of the conventional sheet processing apparatus.
Figure 4:
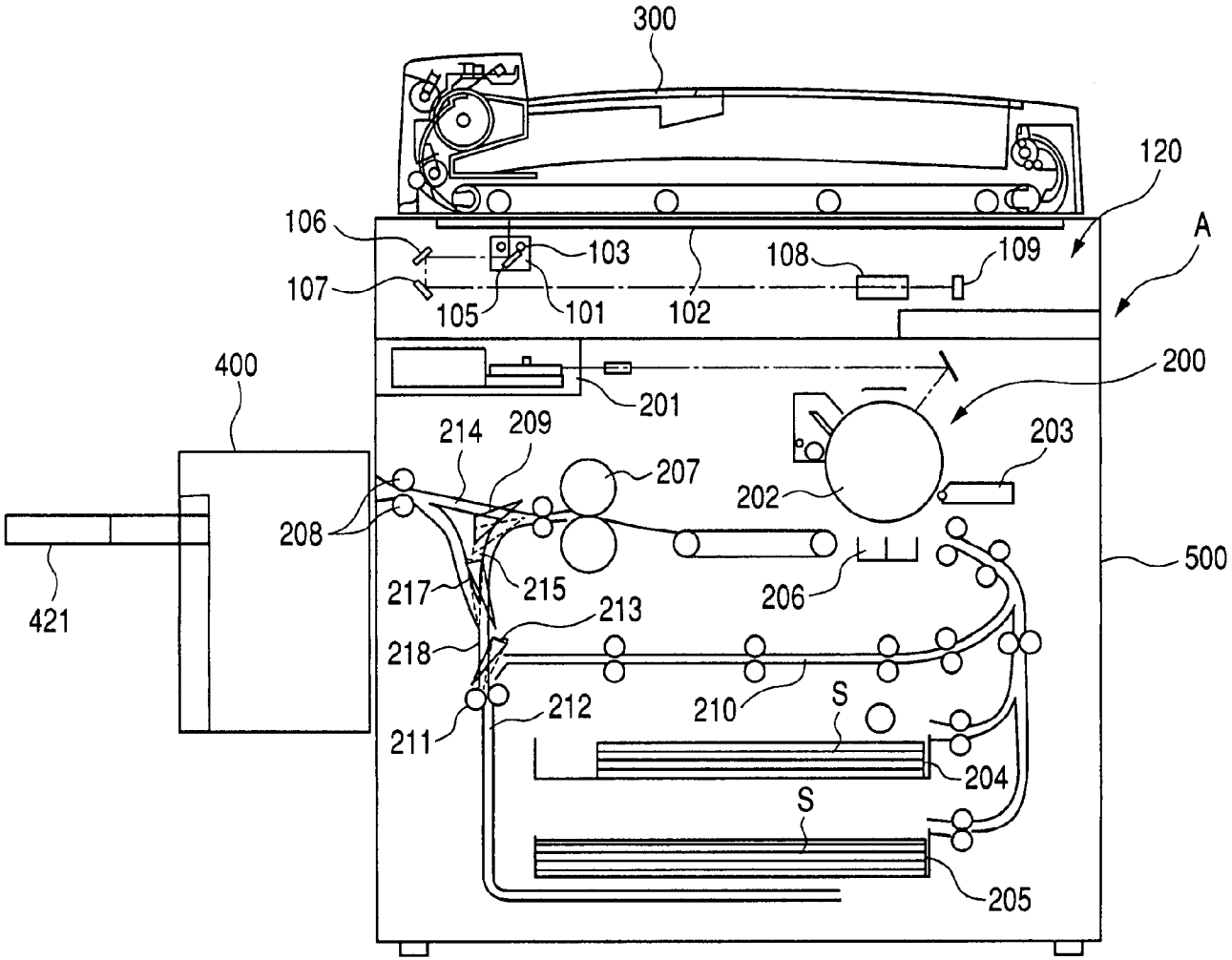
FIG. 4 is a cross-sectional view showing the constructions of a sheet processing apparatus and an image forming apparatus according to an embodiment of the present invention.

FIG. 4 is a cross-sectional view showing the constructions of a sheet processing apparatus and an image forming apparatus according to an embodiment of the present invention. In FIG. 4, the image forming apparatus A is provided with an image forming apparatus main body 500 and an automatic document feeder (ADF) 300 provided on the upper surface of the image forming apparatus main body 500. A sheet processing apparatus 400 as a sheet after treatment apparatus for effecting the after treatment of a sheet discharged from the image forming apparatus A of the present invention is mounted externally of the image forming apparatus main body 500.

Figure 5:
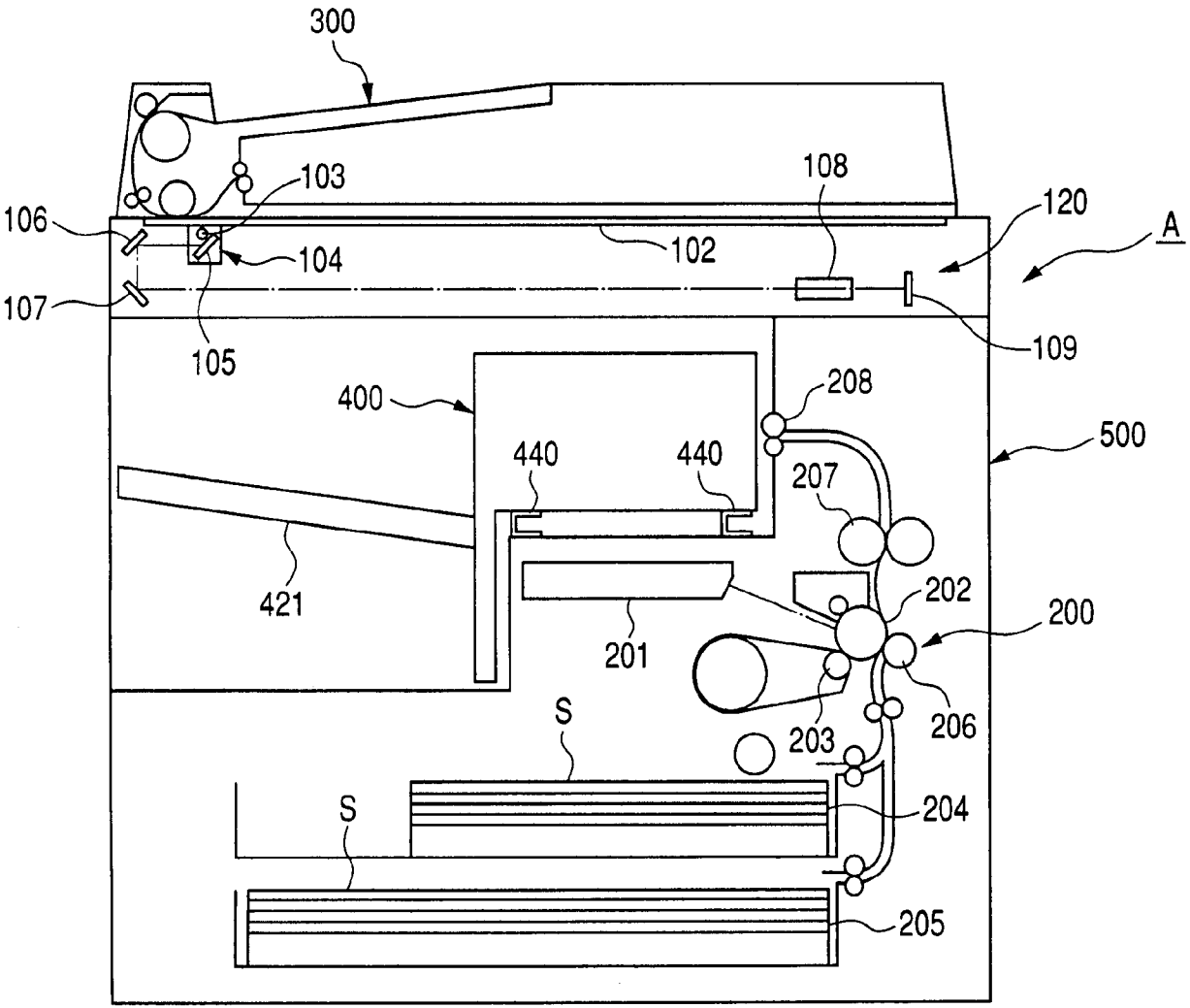
FIG. 5 is a cross-sectional view showing the construction of an image forming apparatus provided with a sheet processing apparatus according to another embodiment of the present invention.

The image forming apparatus according to the present invention is not restricted to the image forming apparatus shown in FIG. 4, but may be an image forming apparatus shown in FIG. 5. FIG. 5 is a cross-sectional view showing the construction of an image forming apparatus provided with a sheet processing apparatus according to another embodiment of the present invention. In FIG. 5, the image forming apparatus A is provided with an image forming apparatus main body 500, an automatic document feeder (ADF) 300 and a sheet processing apparatus 400. The sheet processing apparatus 400 is designed to be capable of being drawn out obliquely with respect to a conveying direction by a rail member 440 and being replenished with the needles of a stapler unit 420.

A reader portion (image reading apparatus) 120 is adapted to convert an original into image data with reference to the image forming apparatus A shown in FIG. 4. For example, a printer portion 200 which is image forming means has a plurality of types of sheet cassettes 204 and 205, and is adapted to output the image data as a visible image onto a sheet by a print command.

When in the image forming apparatus A of such a construction, an original image is to be read to thereby form an image, originals stacked on the automatic document feeder (ADF) 300 are first conveyed one by one onto a platen glass surface 102 by the automatic document feeder (ADF) 300.

Next, when the original is thus conveyed to a predetermined position on the platen glass surface 102, the lamp 103 of the reader portion 120 is turned on and a scanner unit 101 is moved and irradiates the original. Reflected light from this original is inputted to a CCD image sensor portion 109 through the intermediary of mirrors 105, 106, 107 and a lens 108, and electrical processing such as photoelectric conversion is effected in this CCD image sensor portion 109, and ordinary digital processing is effected.

Next, the image signal thus subjected to the electrical processing is converted into a modulated optical signal by the exposure controlling portion 201 of the printer portion 200, and irradiates a photosensitive drum 202. By this irradiating light, a latent image is formed on the photosensitive drum 202, and this latent image is developed by a developing device 203 with a result that a toner image is formed on the photosensitive drum 202.

Next, in timed relationship with the leading edge of this toner image, a sheet S is conveyed from the sheet cassette 204 or 205, and in a transferring portion 206, the toner image is transferred to the sheet S. Thereafter, the toner image transferred to the sheet S is fixed by a fixing portion 207, and after the toner image has been thus fixed, the sheet S is discharged from a sheet discharging portion 208 to the outside of the image forming apparatus. In the image forming apparatus shown in FIG. 5, the sheet S is conveyed from the sheet discharging portion 208 into the sheet processing apparatus 400.

Then, the sheet S outputted from the sheet discharging portion 208 is conveyed to the sheet processing apparatus 400, where a treatment such as sorting or stapling is effected in conformity with an operating mode designated in advance.

When images successively read in are to be outputted to the two sides of a sheet S, the sheet S on one side of which the toner image has been fixed is first directed to a path 215 by a changeover member 209 being once changed over to a solid-line direction in FIG. 4, and is conveyed to a reversing path 212 via a path 218 by a direction changeover member 213 being changed over to a broken-line direction.

Next, after the trailing edge of the sheet has passed the direction changeover member 213, the direction changeover member 213 is changed over to a solid-line direction, and the rotational direction of a roller 211 is reversed to thereby direct the sheet to a path 210, whereafter the sheet is conveyed to the transferring portion 206 so that an image may be formed on the back side of the sheet S.

Figure 6:
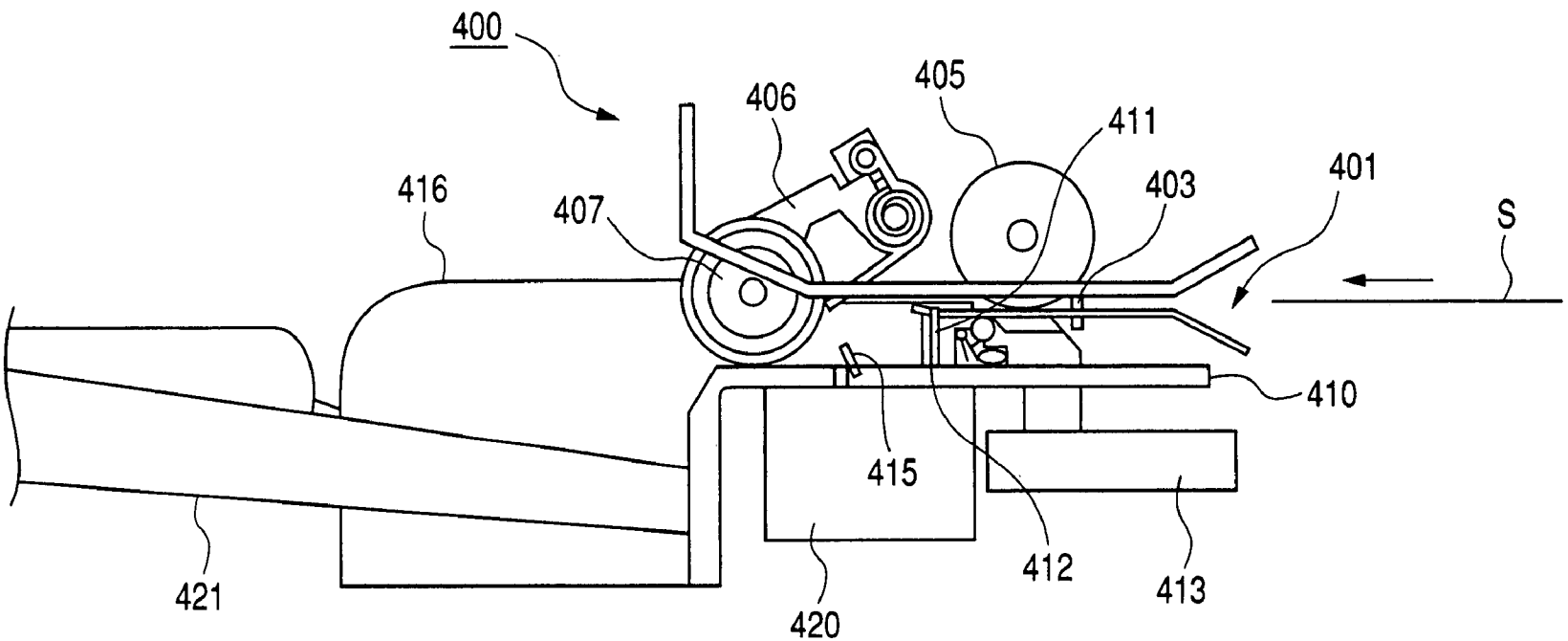
FIG. 6 illustrates the construction of the sheet processing apparatus.

The sheet processing apparatus 400 is provided with a stapling function which is a binding operation by the stapler unit, in addition to a sorting operation of sorting the sheet. As shown in FIG. 6, the sheet processing apparatus 400 is provided with a treatment tray 410 for treating the sheets S successively discharged from the image forming apparatus main body 500, and a stack tray 421 for finally stacking thereon the sheet bundle treated on the treatment tray 410, and is adapted to form a sheet bundle corresponding in the number of sheets to the number of originals on the treatment tray 410, and discharge each sheet bundle to the stack tray 421.

Figure 7:
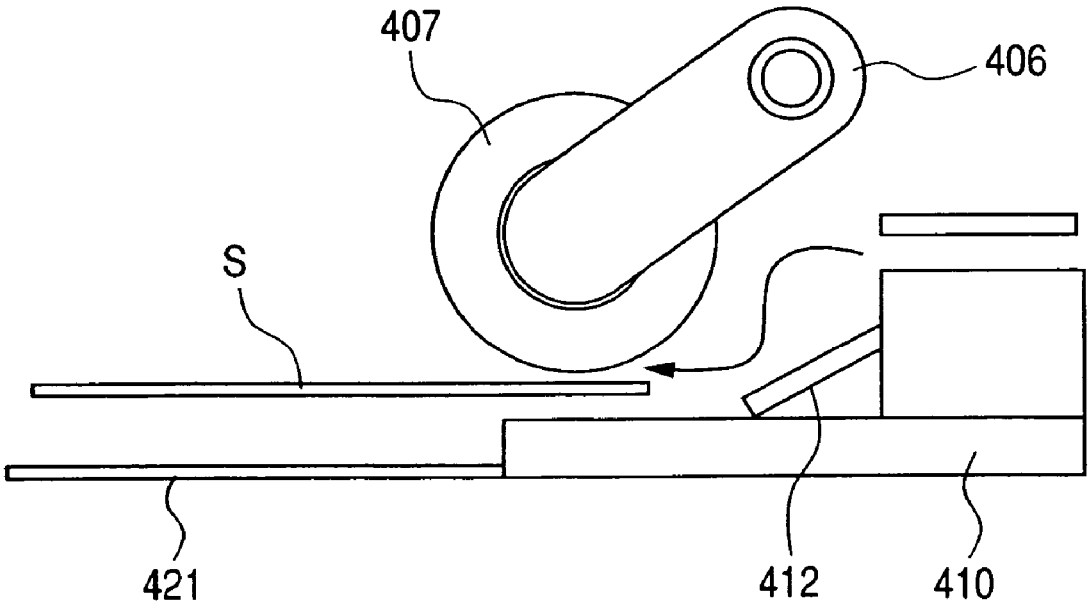
FIG. 7 shows the manner in which a sheet is discharged onto the treatment tray of the sheet processing apparatus.

In FIG. 6, a sheet receiving portion 401 is adapted to receive the sheet S discharged from the image forming apparatus main body 500. The sheet S received by this sheet receiving portion 401 is detected by an entrance sensor 403, and thereafter is conveyed by a conveying roller 405 an offset roller 407 as moving means, and thereafter, as shown in FIG. 7, is discharged onto the treatment tray 410 as first sheet stacking means. The sheets S thus stacked on the treatment tray 410 have their presence or absence detected by a sheet bundle discharge sensor 415 shown in FIG. 6.

Figure 8:
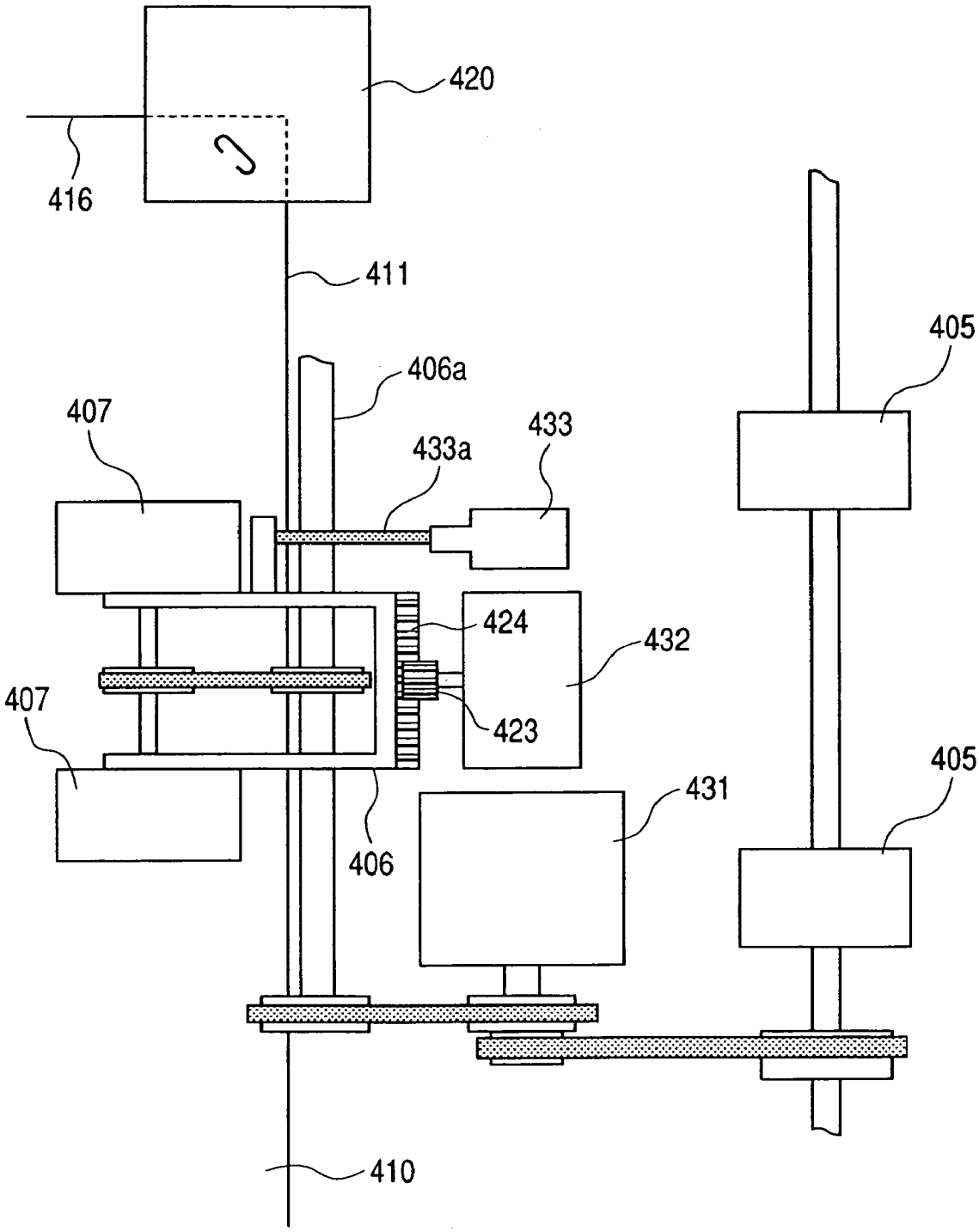
FIG. 8 illustrates a driving mechanism for the offset roller and conveying roller of the sheet processing apparatus.
Figure 9:
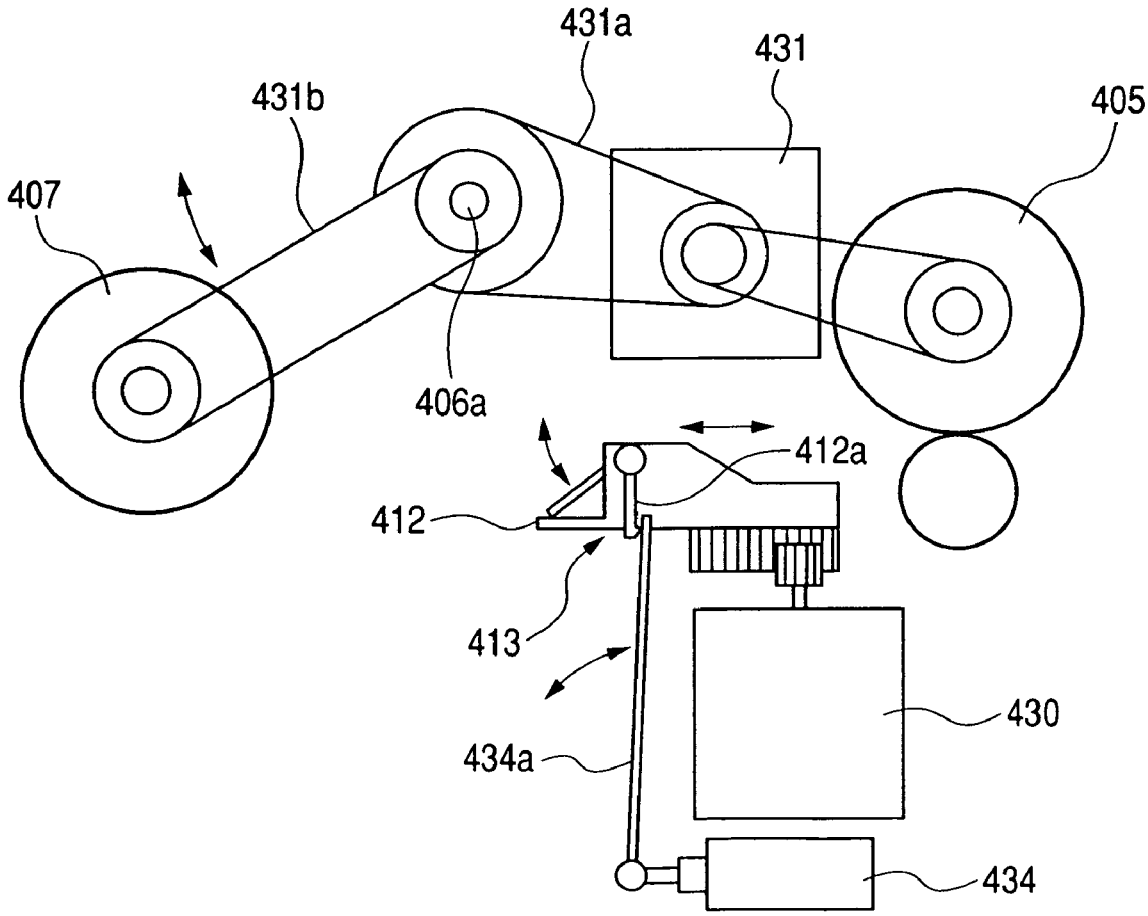
FIG. 9 illustrates a driving mechanism for the offset roller, conveying roller, sheet bundle discharging member and sheet clamp member of the sheet processing apparatus.

The offset roller 407 as sheet conveying means constituted by a cylindrical member has an outer peripheral portion which is an elastic material such as rubber or a foamed material having elasticity approximate to that of rubber, and this offset roller 407 is held for upward and downward movement by an offset roller arm 406 movable in a vertical direction about a shaft 406*a* shown in FIGS. 8 and 9.

This offset roller 407, when it conveys the sheet S to the treatment tray 410, is adapted to be moved to an upper position which does not hinder the conveyance of the sheet S through the offset roller arm 406 with a pickup solenoid 433 as position controlling means turned on, whereby the sheet S is conveyed onto the treatment tray 410 without being hindered by the offset roller 407.

This offset roller arm 406 is movable up and down with the shaft 406*a* as a fulcrum by the pickup solenoid 433. That is, the offset roller 407 is moved up and down by the ON/OFF of the pickup solenoid 433 through a down lever 433*a*.

Also, this offset roller 407, as shown in FIG. 9, is adapted to be driven by a conveying motor 431 capable of being forwardly and reversely rotated which drives the conveying roller 405, through belts 431*a* and 431*b*, and when the conveying motor 431 is rotated, the offset roller is adapted to be rotated in the conveying direction (forward rotation), or rotated in a direction reverse to the conveying direction (hereinafter referred to as the reverse rotation), by an amount conforming to the amount of rotation of the conveying motor 431.

In the present embodiment, design is made such that when a predetermined period of time corresponding to a size of sheet has elapsed after the entrance sensor 403 detects a leading edge of the sheet, the pickup solenoid 433 is turned off, whereby the offset roller 407 moves down from gravity and lands on (contacts with) the sheet, and thereafter is adapted to be rotated in the sheet conveying direction for a predetermined time, and to be reversely rotated when a predetermined time further elapses.

By the offset roller being thus reversely rotated, the trailing edge of the sheet is rammed against a sheet trailing edge stopper 411 as a regulating member provided upright on the upstream end portion of the treatment tray 410 with respect to the conveying direction for regulating the position of the sheet S in the sheet conveying direction to thereby effect the alignment of the sheet S in the conveying direction.

In FIG. 8, a side edge positioning wall (side edge regulating member) 416 as side edge positioning means is a wall which provides the aligning position reference of the end portion of the sheet S in a direction (hereinafter referred to as the width direction) intersecting with the sheet conveying direction. The stapler unit 420 is disposed near the side edge positioning wall 416 of the treatment tray 410, and is adapted to effect a stapling treatment on a sheet bundle formed on the treatment tray 410. The offset roller 407 is adapted to be moved in the width direction by the driving of an offset motor 432 through a pinion 423 and a rack 424, and be capable of approaching the side edge positioning wall 416.

Design is made such that when the offset roller 407 thus approaches the side edge positioning wall 416, the sheet rammed against the sheet trailing edge stopper 411 and aligned in the conveying direction is moved to the side edge positioning wall 416 by the frictional force of the offset roller 407 and the positioning thereof in the width direction is effected. After the sheet S has been rammed against the side edge positioning wall 416, the offset roller 407 is adapted to be slidingly moved on the sheet and stopped.

Figure 10A:
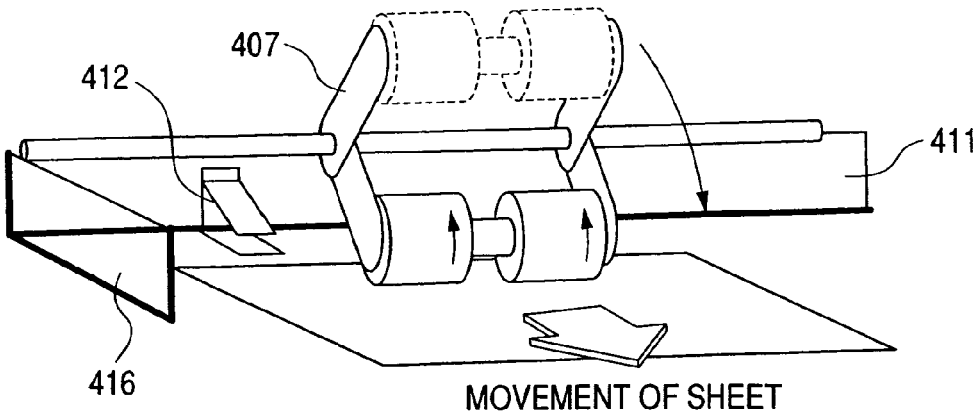
FIGS. 10A, 10B and 10C are first figures illustrating the operation of the offset roller and the resultant movement of the sheet.
Figure 10B:
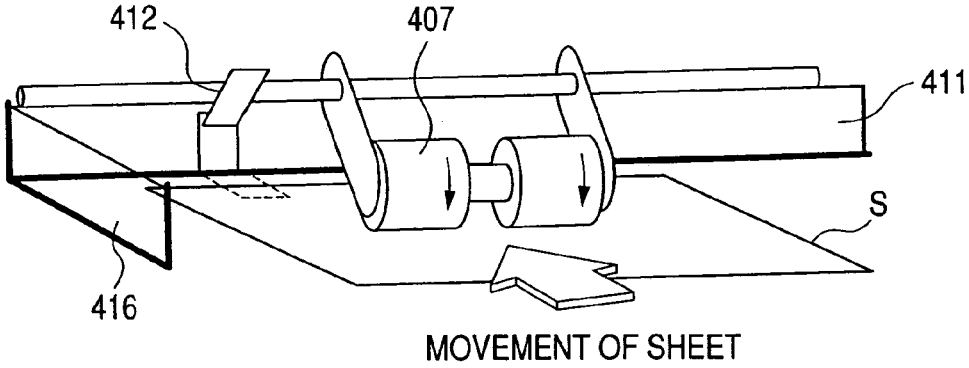

By such an offset roller 407 being provided, the sheet discharged onto the treatment tray 410 is conveyed to the stack tray side by the offset roller 407 rotated in the sheet conveying direction, as shown in FIG. 10A, whereafter as shown in FIG. 10B, the sheet is returned to the sheet trailing edge stopper 411 by the reverse rotation of the offset roller 407, and thereafter has its trailing edge rammed against the sheet trailing edge stopper 411 and is aligned.

In FIGS. 10A to 10C, and FIGS. 11A, 11B, 12A and 12B which will be described later, unlike FIG. 8 already described, description is made by the use of a construction in which the offset roller 407 is disposed inside the offset roller arm 406, but this difference in construction is merely a difference simply in design, and there is no difference in function and action from the construction shown in FIG. 8.

Figure 10C:
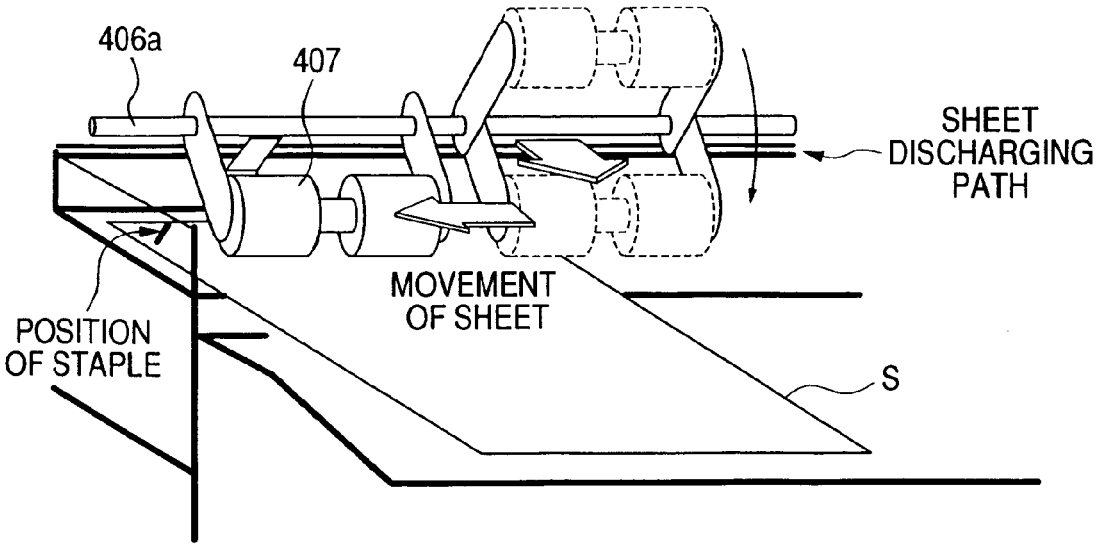

Thereafter, as shown in FIG. 10C, the offset roller 407 is moved to the positioning wall side along the shaft 406*a* in a state in which it has landed on the sheet S, whereby the end portion of the sheet S in the width direction thereof is pushed against the positioning wall 416, and the alignment of the sheet S in the width direction is effected.

Figure 11A:
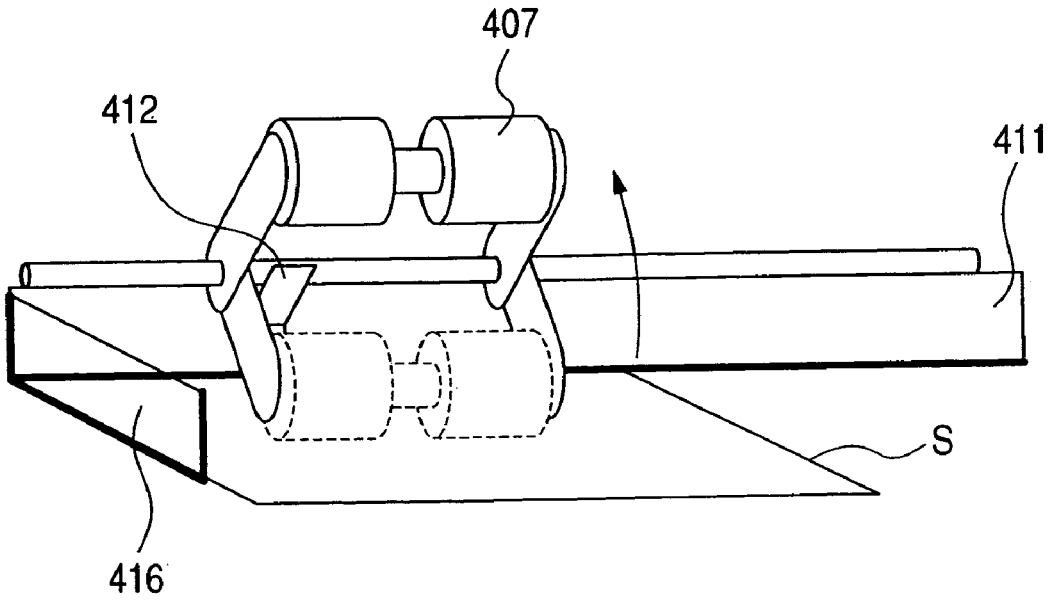
FIGS. 11A and 11B are second figures illustrating the operation of the offset roller and the resultant movement of the sheet.
Figure 11B:
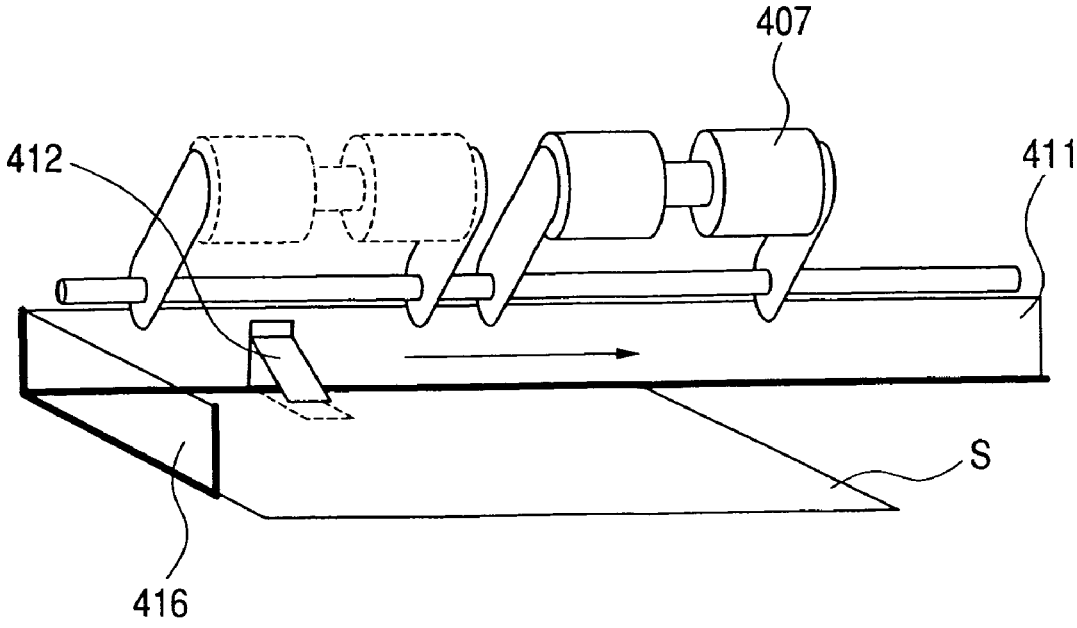

On the other hand, in FIG. 9, a sheet clamp member 412 is sheet bundle holding means for holding down the trailing edge portion of the aligned sheet S from above it by the biasing force of biasing means (not shown). As will be described later, the alignment of the trailing edge of the sheet is effected after the alignment of the sheet S in the width direction has been completed. When as shown in FIG. 11A, the offset roller 407 is raised by a pickup solenoid 433 after the alignment of the trailing edge of the sheet has been completed, the aligned sheet S is adapted to be held down from above it as shown in FIG. 11B by the sheet clamp member 412.

Thereby, the sheet S discharged earlier onto the treatment tray 410 can be held at a predetermined position without being conveyed with and by successively fed sheets S.

Figure 12A:
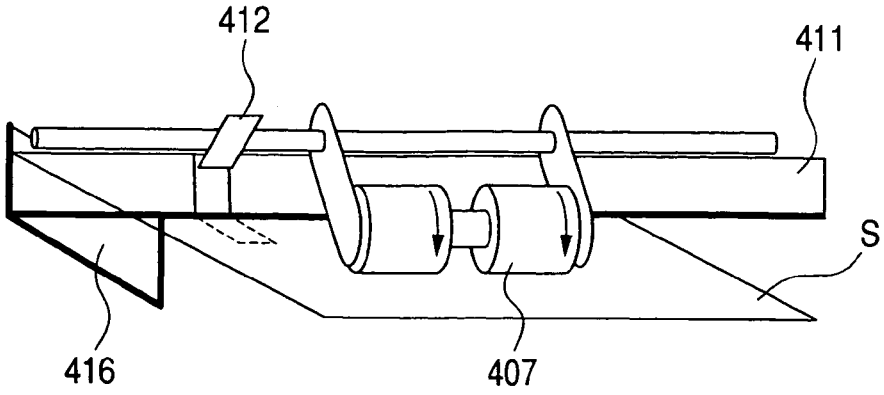
FIGS. 12A and 12B illustrate the operation of the sheet clamp member.
Figure 12B:
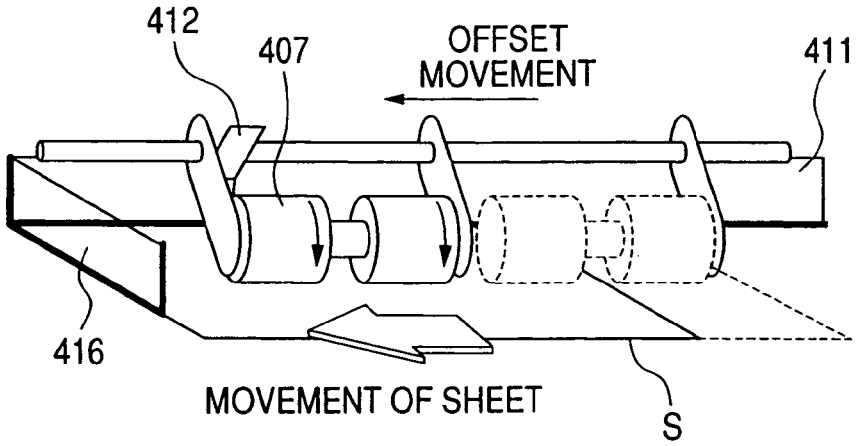

This sheet clamp member 412, when the offset roller 407 is being reversely rotated, is upwardly pivotally moved as shown in FIG. 12A so as to be capable of receiving the sheet S, and when the sheet S is moved in the width direction with the offset roller 407 in order to align the edge portion, is upwardly pivotally moved as shown in FIG. 12B so as not to be the load of the movement of the sheet S.

Also, in FIG. 9, a sheet bundle discharging member 413 is sheet bundle discharging means for discharging the treated sheet bundle onto the stack tray 421. This sheet bundle discharging member 413 is adapted to pivotally hold the sheet clamp member 412 and to move an aligned sheet bundle or a sheet bundle stapled after aligned toward the stack tray 421 as second sheet stacking means provided downstream of the treatment tray 410 as shown in FIG. 13 in a state in which it is held by the sheet clamp member 412.

Figure 13:
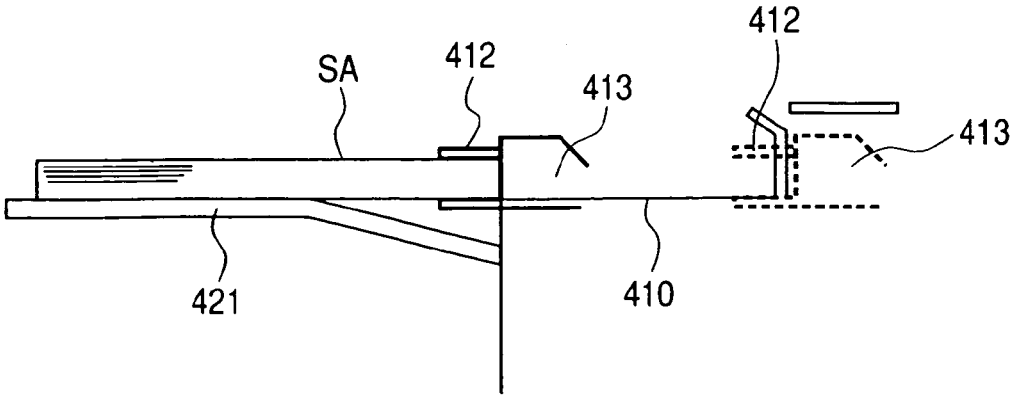
FIG. 13 shows the manner in which the sheet bundle discharging member discharges a sheet bundle onto a stack tray.

Further, when the sheet bundle thereafter arrives at the fore end portion of the treatment tray 410 which is a sheet discharging position indicated by solid line in FIG. 13, the holding of the sheet bundle SA by the sheet clamp member 412 is released on the stack tray 421 so that the sheet bundle SA may be discharged onto and stacked on the stack tray 421.

This sheet bundle discharging member 413 have motive power transmitted thereto by a sheet bundle discharging motor 430 as holding means moving means through a rack and a pinion, as shown in FIG. 9, whereby it can be reciprocally moved between a position for discharging the sheet bundle to the stack tray 421 (discharging position) and a home position as a holding position for holding the sheet bundle near the sheet trailing edge stopper 411. This sheet bundle discharging member 413 is normally fixed at the home position by the excitation of the sheet bundle discharging motor 430.

In FIG. 9, a clamp solenoid 434 pivotally moves the sheet clamp member 412. This clamp solenoid 434, when the offset roller 407 stops rotating after it has conveyed the sheet, and when the offset roller 407 is moved in the width direction, is adapted to be turned on to thereby upwardly pivotally move the sheet clamp member 412 through a lever 434*a* and a releasing lever portion 412*a* provided on the sheet clamp member 412.

In the present embodiment, design is made such that in order to correct the deviation of the sheet in the conveying direction after the sheet S has been moved in the width direction, the offset roller 407 is again reversely rotated to thereby complete the aligning operation, whereby highly accurate alignment is realized. When the aligning of a designated number of sheets is completed, the sheet clamp member 412 is adapted to be closed by this clamp solenoid 434 and hold the sheet bundle.

Figure 14:
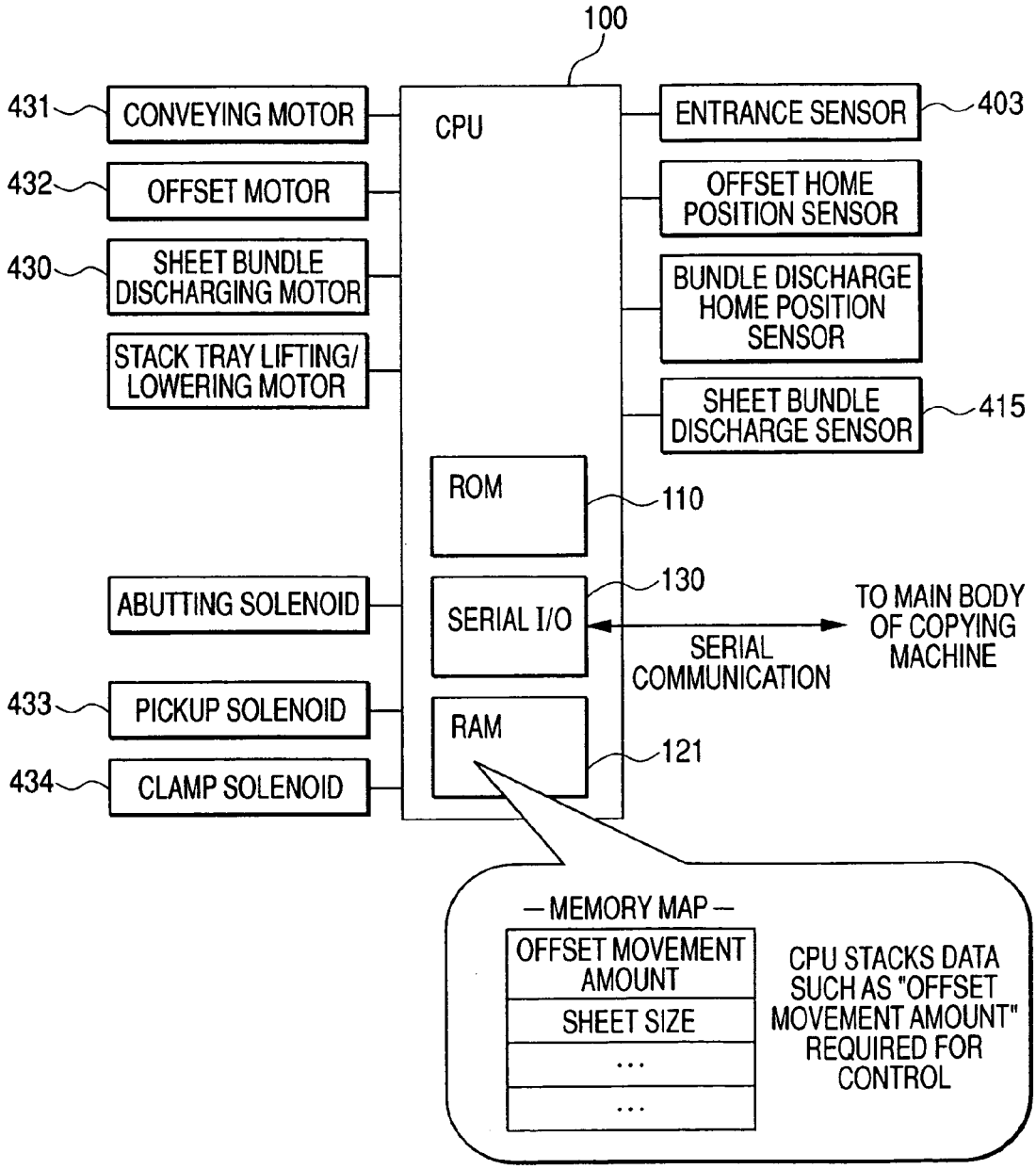
FIG. 14 is a block diagram showing the construction of the controlling portion of the sheet processing apparatus.

FIG. 14 is a block diagram showing the construction of the controlling portion of the sheet processing apparatus 400 of such a construction. A CPU 100 as controlling means in the present embodiment has a ROM 110 therein. The ROM 110 has stored therein a program, etc. corresponding to a control procedure shown in FIGS. 17 and 18 which will be described later. The CPU 100 is adapted to read out and execute this program and effect the control of each portion.

Also, the CPU 100 contains therein a RAM 121 in which data for work and input data are stored, and the CPU 100 is adapted to effect the control with reference to the data contained in the RAM 121 on the basis of the aforementioned program. Further, sensors such as an entrance sensor 403 and a sheet bundle discharge sensor 415 are connected to the input port of the CPU 100, and motors and solenoids such as a conveying motor 431, an offset motor 432, a sheet bundle discharging motor 430, a pickup solenoid 433 and a clamp solenoid 434 are connected to the output port of the CPU 100. The CPU 100 is adapted to control the loads of the various motors and solenoids connected to the output port in accordance with the aforementioned program, on the basis of the states of these sensors.

Also, the CPU 100 is provided with a serial interface portion (I/O) 130, and is adapted to effect the giving and receiving of control data with (the controlling portion of) the image forming apparatus main body 500, and also effect the control of each portion on the basis of control data sent from (the controlling portion of) the image forming apparatus main body 500 through the serial interface portion (I/O) 130.

The image forming apparatus main body 500 grasps the size of the sheet discharged from the sheet discharging portion 208 and therefore, it is possible for the controlling portion of the sheet processing apparatus 400 comprising a microcomputer system to effect serial communication with the controlling portion of the image forming apparatus main body 500 to thereby grasp the size of the sheet inserted onto the treatment tray 410.

Accordingly, each time a sheet S is discharged (conveyed) from the image forming apparatus main body 500, the controlling portion (CPU 100) of the sheet processing apparatus 400 can grasp the size thereof, and control the offset motor 432 to thereby control the amount of movement of the offset roller 407 in the width direction so as to become an amount of movement conforming to the size of the sheet. Thereby, the offset roller 407 can be moved by an amount conforming to the size of the sheet discharged onto the treatment tray 410, and can reliably bring the side edge of the sheet S into contact with the positioning wall 416.

In the present embodiment, the sheet bundle stacked on the stack tray 421 constitutes a portion of the treatment tray 410 and therefore, when the discharge of the sheet bundle SA is done from the treatment tray 410, the stack tray 421 is adapted to be lowered by a stack tray lifting lowering motor (see FIG. 14) until the uppermost surface of the stacked sheet bundle substantially coincides with the treatment tray 410.

Figure 15:
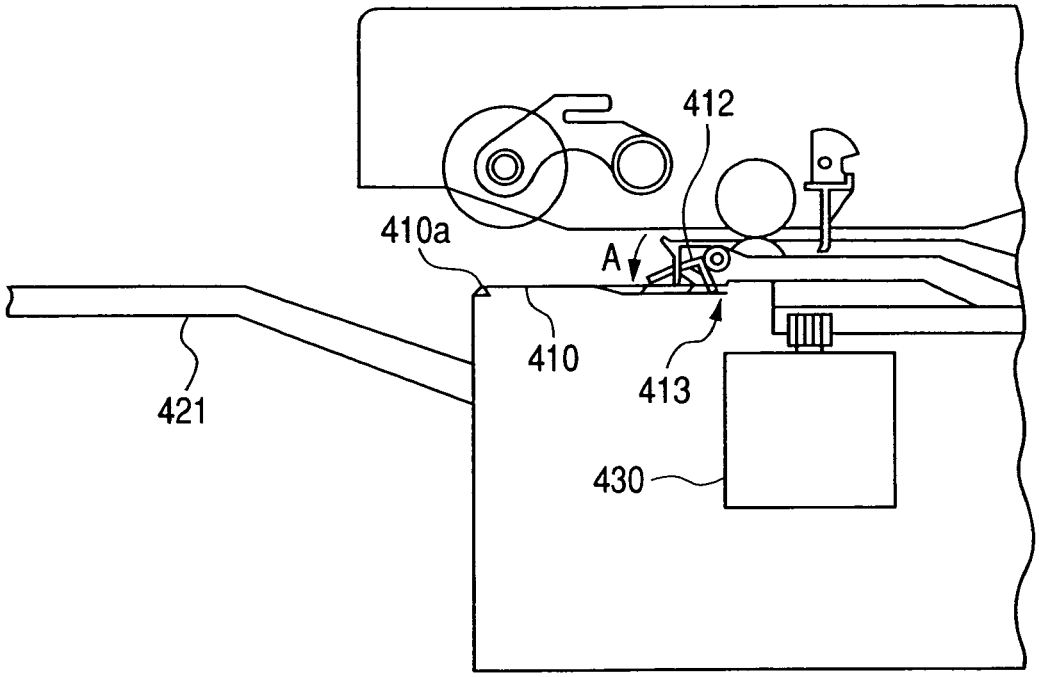
FIG. 15 shows the state before the sheet is discharged onto the treatment tray of the sheet processing apparatus.
Figure 16:
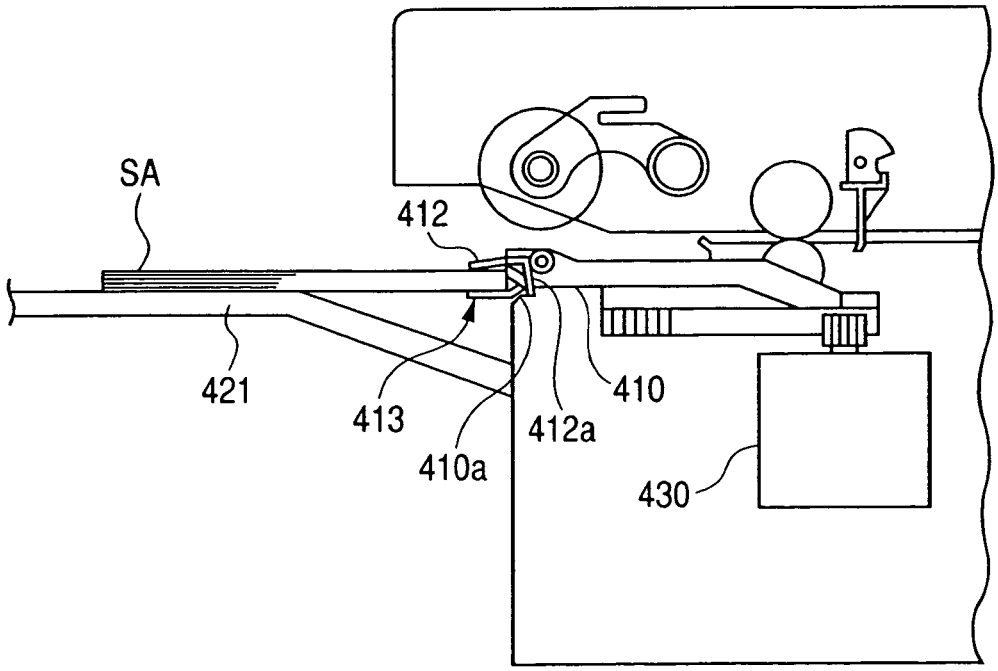
FIG. 16 shows the state when the sheet bundle discharging member has been moved to a position in which it discharges the sheet bundle to the stack tray.

Now, in FIG. 15, a recess 410*a* is formed in the upper surface of the fore end of the treatment tray 410, and extends by a predetermined distance in a direction opposite to the direction of movement of the sheet bundle discharging member 413. Design is made such that when the sheet bundle discharging member 413 arrives at the fore end portion of the treatment tray 410, and thereafter is once stopped, and then is returned to its home position, the lower end of a releasing lever portion 412*a* as the lever portion of the sheet clamp member 412 moves along the recess 410*a*.

This releasing lever portion 412*a* is adapted to slide in pressure contact with the treatment tray 410 when the sheet bundle discharging member 413 is moved, whereby the releasing lever portion 412*a* is moved to a position facing the recess 410*a*, whereupon the releasing lever portion 412*a* resiliently comes into the recess.

When thereafter, the sheet bundle discharging member 413 is moved by a predetermined distance, the releasing lever portion 412*a* is restrained on the side edge of the recess 410*a*, and when the sheet bundle discharging member 413 is further moved, the releasing lever portion 412*a* is pivotally moved in a clockwise direction, and along therewith, the sheet clamp member 412 is adapted to be upwardly pivotally moved.

That is, the recess 410*a* as a hold releasing portion is formed in the upper surface of the fore end of the treatment tray 410, and when the sheet bundle discharging member 413 is moved back toward its home position, the releasing lever portion 412*a* of the sheet clamp member 412 is restrained on the side edge of the recess 410*a*, whereby the sheet clamp member 412 comes to be upwardly pivotally moved (moved) from a first position for holding the sheet bundle to a second position for releasing the hold of the sheet bundle.

The predetermined distance by which the sheet bundle discharging member 413 movable to the first position and the second position is moved to thereby upwardly pivotally move the sheet clamp member 412 is a distance by which the sheet bundle SA falls onto the stack tray with the aid of gravitational force of the sheet bundle SA when the hold by the sheet clamp member 412 has been released.

Design is made such that when as described above, the sheet bundle SA is to be stacked on the stack tray, the sheet bundle discharging member 413 is once stopped, whereafter the sheet bundle SA is made to fall, whereby the inertial force of the sheet bundle SA can be reduced to thereby make the falling position of the sheet bundle always constant. As the result, when the sheet bundle SA is to be placed on the substantially horizontal stack tray 421, the alignment deviation by the inertial force of the sheet bundle SA can be prevented, and the deviation between sheet bundles can also be prevented to thereby improve the stacking property of the sheet bundle SA on the stack tray.

The sheet processing operation of the sheet processing apparatus 400 of the present embodiment constructed as described above will now be described with reference to flow charts shown in FIGS. 17 and 18.

First, when the image forming operation of the image forming apparatus main body 500 is started, the CPU 100 (see FIG. 14) of the sheet processing apparatus 400 checks up whether a sheet discharging signal has been received from the image forming apparatus main body 500 (S100). If the sheet discharging signal has been received (Yes at S100), the pickup solenoid 433 is turned on (S110) to thereby pull up the offset roller 407 supported by the offset roller arm 406.

Next, the conveying motor 431 is turned on (S120) so that the conveying roller 405 installed intermediately of the sheet discharging path can convey the sheet in the same direction as the sheet discharging direction of the image forming apparatus main body 500. Here, the leading edge of the first sheet passes the entrance sensor 403 and turns the entrance sensor 403 on (Yes at S130), whereafter the sheet arrives at the conveying roller 405 and there is brought about a state in which motive power is transmitted from the conveying roller 405 to the sheet, and the sheet is separated from the sheet discharging portion 208 (see FIG. 4 or 5) of the image forming apparatus main body 500 (Yes at S140), whereupon the delivery of the sheet is completed.

Next, before the sheet completely leaves the conveying roller 405 while the sheet is conveyed to the treatment tray 410 by the conveying roller 405, the pickup solenoid 433 is turned off (S150), and the offset roller 407 is made to land on the sheet from gravity. Thereafter, as shown in FIG. 10A, the sheet S is conveyed to a predetermined position by the offset roller 407 (S160). When the sheet S is conveyed to the predetermined position (Yes at S160), the rotation of the conveying motor 431 is stopped (S170), thus stopping the conveyance of the sheet S.

Next, at a point of time whereat the rotation of the offset roller 407 has been stopped, the clamp solenoid 434 is turned on (S180), and as shown in FIG. 10B, the sheet clamp member 412 installed near the sheet trailing edge stopper 411 is opened. Thereafter, the conveying motor 431 is rotated in a direction reverse to the conveying direction, and the sheet S is pulled back by the offset roller 407 (S190), and the trailing edge of the sheet is rammed against the sheet trailing edge stopper 411.

The amount of rotation of the offset roller 407 when the trailing edge of the sheet is rammed against the sheet trailing edge stopper 411 is such an amount of rotation that with the skew feed of the sheet S occurring when the sheet is sent from the image forming apparatus main body 500 taken into account, the sheet can be conveyed somewhat more than the distance from a point at which the conveyance of the sheet S is stopped and the sheet S is switched back to the sheet trailing edge stopper 411. That is, the offset roller 407 is designed to be reversely rotated for a predetermined time still after it has conveyed the sheet S by a distance for causing it to abut against the sheet trailing edge stopper 411.

Thereby, the sheet S can be reliably caused to abut against the sheet trailing edge stopper 411. If the sheet S abuts against the sheet trailing edge stopper 411 while the offset roller 407 is thus reversely rotated for a predetermined time, the offset roller 407 is adapted to idly rotate (slip) on the sheet.

Next, the size of the discharged sheet is checked up by size information from the image forming apparatus main body 500 (S200), and an amount of offset movement conforming to the size of the discharged sheet (the length of the sheet S in the width direction), i.e., the movement distance of the sheet S in the width direction necessary to urge the sheet S discharged onto the treatment tray 410 against the positioning wall 416, is calculated (S210). This amount of offset movement is an amount resulting from adding a predetermined amount to a distance conforming to the length of the sheet S in the width direction which enables the sheet S to abut against the positioning wall 416.

Thereafter, the offset roller 407 is offset—moved to the positioning wall 416 by the offset motor 432 through a rack and a pinion, as shown in FIG. 10C (S220). Here, when the offset roller 407 is thus moved, the sheet S being in contact with the offset roller 407 is moved with the offset roller toward the positioning wall 416 by the frictional force of the offset roller 407. At this time, the sheet clamp member 412 is upwardly pivotally moved as shown in FIG. 12B so as not to become the load of the movement of the sheet S.

By such offset movement of the offset roller 407, as shown in FIG. 10C, the sheet strikes against the positioning wall 416, whereby the alignment of the sheet S in the width direction is effected. The offset roller 407 rams the sheet S against the positioning wall 416, and thereafter continues its sheet moving operation for a predetermined time, whereby it slides (slips) somewhat on the sheet S and is stopped. Thereafter, in order to correct the alignment deviation in the conveying direction after the offset movement, the offset roller 407 is again reversely rotated to thereby perform the aligning operation of pulling back the sheet S (S230), whereby the alignment of the first sheet S is completed.

By so constructing, that is, by moving the offset roller 407 in the width direction each time a sheet S is conveyed, the sheet S can be moved by a distance which enables the sheet S to abut against the positioning wall 416 and further, the sheet moving operation of this offset roller 407 can be continued for a predetermined time to thereby reliably cause the sheet S to abut against the positioning wall 416. After it has rammed the sheet S against the positioning wall 416, the offset roller 407 slips on the sheet and therefore, it never happens that alignment deviation or the buckling or the like of the sheet S occurs.

Next, when the alignment of the first sheet S is thus completed, the pickup solenoid 433 is turned on (S240), and as shown in FIG. 11A, the offset roller 407 is raised, whereafter the clamp solenoid 434 is turned off (S250). Thereby, as shown in FIG. 11B, the sheet clamp member 412 is closed, and the aligned sheet S is nipped and held. As the result, the sheet S discharged at first can be prevented from being conveyed with and by the sheet discharged next.

Next, as shown in FIG. 11B, the offset roller 407 in its raised state is returned to its home position by the offset motor 432 through the rack and the pinion (S260).

Whether the sheet S placed on the treatment tray 410 is the last sheet corresponding to the last page of the original to be copied is checked up (S270), and if it is judged on the basis of information sent from the image forming apparatus main body 500 that the sheet S is not the last sheet S (No at S270), return is made to S100, where the afore described flow is repeated until a sheet discharging signal sent next from the image forming apparatus main body 500 is received and the last sheet S is contained in the treatment tray 410.

Thus, each time a sheet S is discharged from the image forming apparatus main body 500, the controlling portion (CPU) of the sheet processing apparatus 400 grasps the size of the sheet S, and also calculates an amount of offset movement suited for that sheet S. As the result, the sheet S being contacted with by the offset roller 407 is subjected to the aligning treatment on the basis of the calculated amount of movement, and is aligned by the positioning wall 416.

On the other hand, if it is judged that the aforementioned sheet S is the last sheet (Yes at S270), it means that a sheet bundle corresponding to the original to be copied is formed on the treatment tray 410 and therefore, next, whether staple treatment, selected is checked up (S280). If the staple treatment is selected (Yes at S280), the stapler unit 420 is driven to thereby execute the staple treatment at a stapling position shown in FIG. 10C (S290).

Next, if the staple treatment is not selected (No at S280) or after the staple treatment has been completed, the sheet bundle discharging member 413 is driven by the sheet bundle discharging motor 430 to thereby advance the sheet bundle SA toward the stack tray 421 while being gripped by the sheet clamp member 412 as shown in FIG. 13, and the sheet bundle SA is moved for discharge (S300).

Next, when the sheet bundle discharging member 413 arrives at the fore end position of the treatment tray 410, the sheet bundle discharging member 413 is once stopped (S305). By the sheet bundle discharging member 413 being thus once stopped, an inertial force acting on the sheet bundle SA becomes null at this point of time.

When thereafter, the sheet bundle discharging member 413 is moved back toward its home position, the lower end of the releasing lever portion 412*a* of the sheet clamp member 412 abuts against the side edge of the recess 410*a* (see FIG. 15) formed in the upper surface of the fore end of the treatment tray 410, whereby the sheet clamp member 412 having so far gripped the sheet bundle SA is upwardly pivotally moved and releases the nipping (holding) of the sheet bundle SA.

When the nipping is thus released, the sheet bundle SA falls onto the stack tray from gravity. At this time, the inertial force of the sheet bundle SA hardly occurs and thus, the sheet bundle SA comes to fall onto a predetermined position on the stack tray, whereby the sheet bundle SA is stacked in its aligned state on the stack tray.

Next, the moving (lowering) treatment of the stack tray 421 is effected in timed relationship with the discharging operation of the sheet bundle SA (S310), whereafter the sheet bundle discharging member 413 is returned to its home position (S320).

Further, thereafter, the conveying motor 431 is stopped to stop the rotation of the conveying roller 405 and the offset roller 407 (S330), and the pickup solenoid 433 is turned off (S340) to thereby lower the offset roller 407, thus completing a series of treatments.

Here, as already described, the amount of rotation of the offset roller 407 when the trailing edge of the sheet is rammed against the trailing edge stopper 411 is set to such an amount of rotation as can convey the sheet somewhat more than the distance from the point at which the conveyance of the sheet S is stopped and the sheet S is switched back to the trailing edge stopper 411, or in other words, the offset roller 407 is reversely rotated for a predetermined time still after by the reverse rotation of the offset roller 407, the sheet S has been conveyed by a distance for causing the sheet S to abut against the trailing edge stopper 411, whereby the sheet S can be reliably caused to abut against the trailing edge stopper 411.

Also, in the present embodiment, each time a sheet S is conveyed, the sheet is moved so as to abut against the positioning wall 416 and further, this sheet moving operation is continued for a predetermined time, whereby the sheet S can be reliably made to abut against the positioning wall 416 even when the length of the sheet S in the width direction is changed by the influence of temperature, humidity or the like.

Thus, by a simple construction which does not require many members, it is possible to stably align the position of the sheet S in the sheet conveying direction. Also, the sheet is not discharged so as to fly and therefore, it is possible to effect the stable conveyance of the sheet which hardly becomes wild.

Now, while in the present embodiment, the stapler unit 420 for stapling the sheet bundle SA is of a fixed type and is disposed near the positioning wall 416, the present invention is not restricted thereto, but the stapler unit 420 may be of a movable type, and may be made movable in the sheet conveying direction or the width direction.

The stapler unit 420 of the movable type is thus used and this stapler unit 420 is made movable in the sheet conveying direction or the width direction, whereby it is possible to staple-treat other portion or a plurality of portions of the sheet bundle SA in the sheet conveying direction or the width direction.

Also, while in the present embodiment, moving means for moving the sheet S in the width direction is constituted by the offset roller 407 as sheet conveying means and the offset motor 432 as driving means for driving the sheet conveying means, the present invention is not restricted thereto, but the moving means may also be constituted by sheet conveying direction moving means for a member itself to move in the conveying direction to thereby convey the sheet as the sheet conveying means, and driving means for moving such sheet conveying direction moving means in the width direction to obtain a similar effect.

Figure 17:
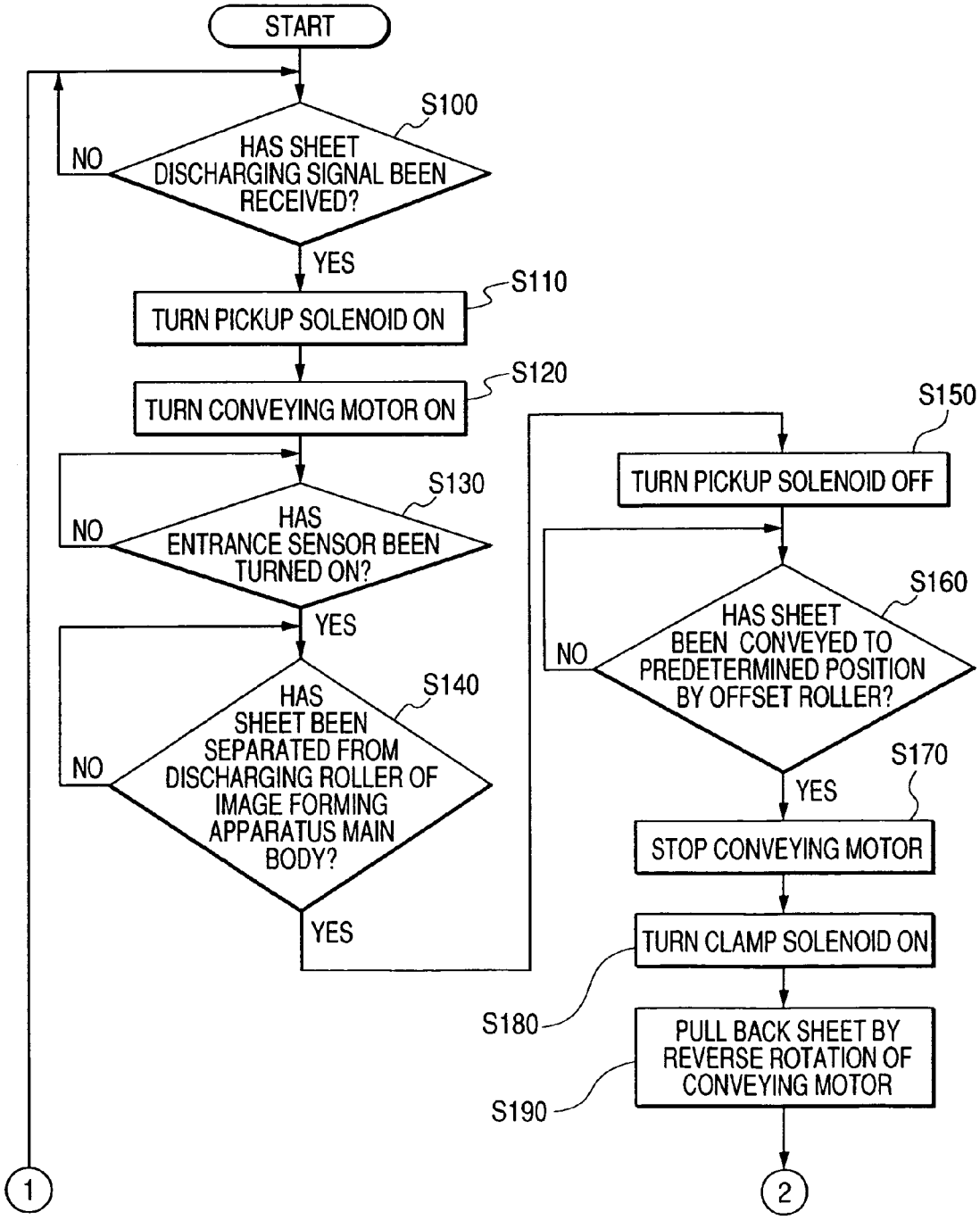
FIG. 17 is a flow chart illustrating a part of the sheet treating operation of the sheet processing apparatus.
Figure 18:
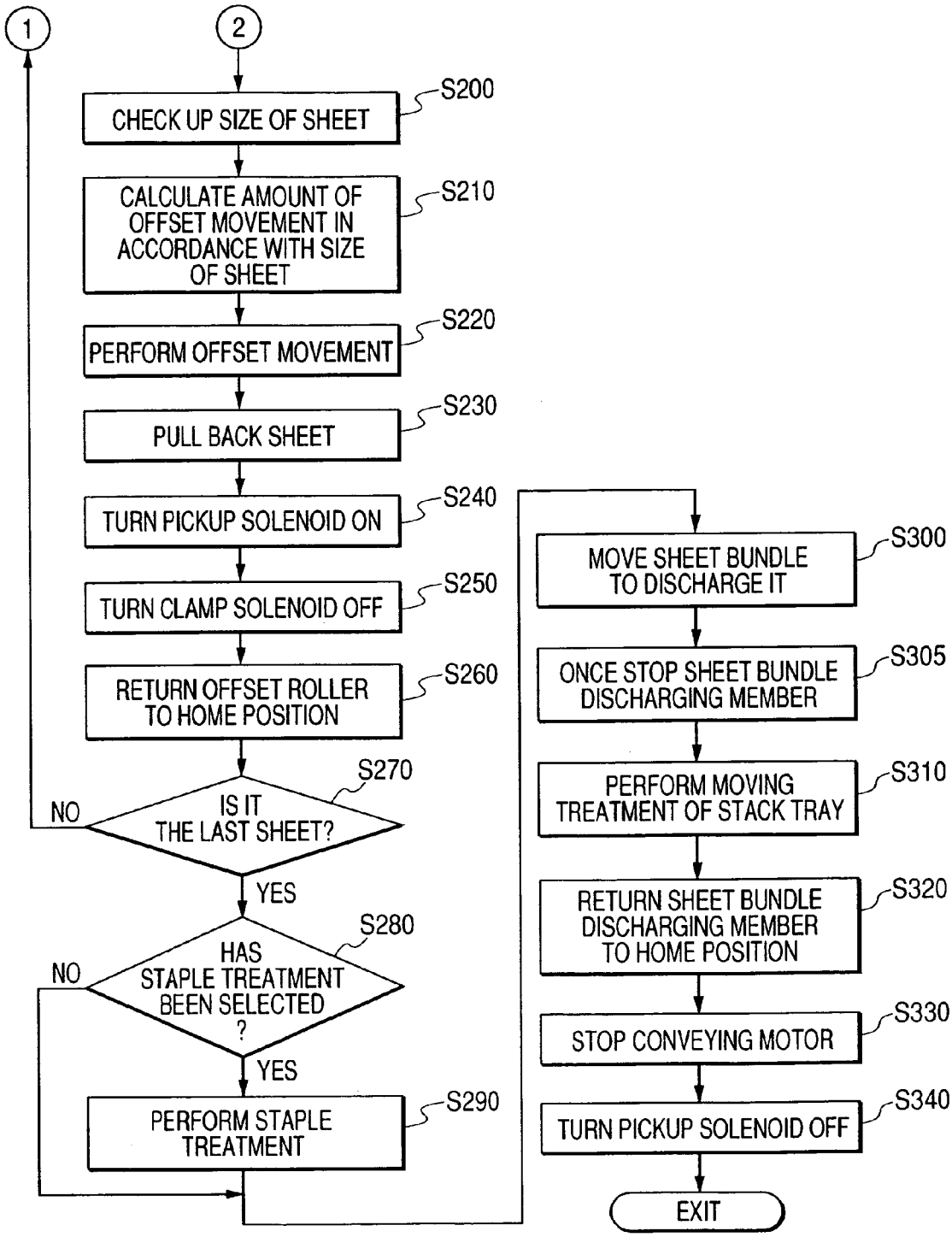
FIG. 18 is a flow chart illustrating the remainder of the sheet treating operation of the sheet processing apparatus.

Further, while in the present embodiment, control is effected while the CPU reads out the program written on the RAM (or ROM) storing therein the program corresponding to the flow charts of FIGS. 17 and 18, design may also be made such that hardware effects the processing in the control program, to obtain a similar effect.

Figure 19:
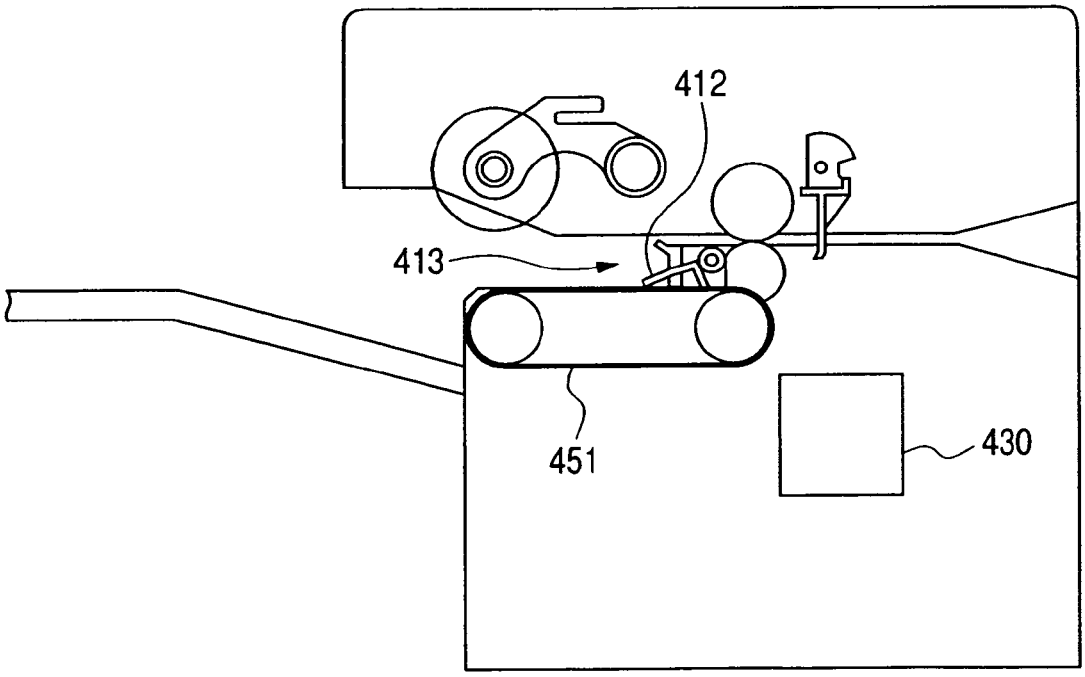
FIG. 19 illustrates other construction of the sheet processing apparatus.

Now, while in the description hitherto made, the movement of the sheet bundle discharging member 413 (sheet clamp member 412) has been effected by the motive power of the sheet bundle discharging motor 430 being transmitted through the rack and the pinion, the present invention is not restricted thereto, but for example, the motive power of the sheet bundle discharging motor 430 may be transmitted through a cam, and as shown in FIG. 19, the motive power of the sheet bundle discharging motor 430 may be transmitted through a belt 451. Further, the present invention is very effective for a substantially horizontal stack tray, but of course, can also be adopted in an apparatus having an inclined stack tray to obtain a better aligning property.

Also, while in the description hitherto made, description has been made of a case where the CPU of the controlling portion provided in the sheet processing apparatus provided in the image forming apparatus controls the operation of the offset roller, etc., the CPU of the controlling portion may be provided in the image forming apparatus main body, and design may be made such that the CPU controls the sheet processing operation of the afore described offset roller, etc.

According to the embodiment of the present invention, when the sheet bundle is to be discharged, the sheet bundle is once stopped, whereafter it is discharged, whereby the influence of the inertial force when the sheet bundle is discharged can be eliminated and therefore, the falling position of the sheet bundle can always be made constant. Thus, by a simple construction, the sheet bundle can be aligned on the stack tray, and the stacking property of the sheet can be improved.

Also, according to the embodiment of the present invention, by the reverse rotation of the sheet conveying means, the sheet can be conveyed so as to abut against the regulating member for regulating the position of the sheet in the sheet conveying direction and further, still thereafter, the sheet conveying means can be reversely rotated for a predetermined time, whereby the sheet can be reliably made to abut against the regulating member. By so constructing, it is possible to stably align the position of the sheet in the sheet conveying direction by a simple construction which does not require many members.

Also, according to the embodiment of the present invention, each time a sheet is conveyed, the sheet can be moved so as to abut against the side edge regulating member for regulating the position of the edge portion of the sheet in the width direction and further, this sheet moving operation can be continued for a predetermined time to thereby reliably make the sheet abut against the side edge regulating member. By so constructing, it is possible to stably align the position of the sheet in the width direction by a simple construction which does not require many members.

Description will now be made of an embodiment in which the sheet processing apparatus is provided with a sheet holding-down member as pressing means. In the following embodiment, members similar to those in the above-described embodiment are given similar reference characters and need not be described.

Figure 20:
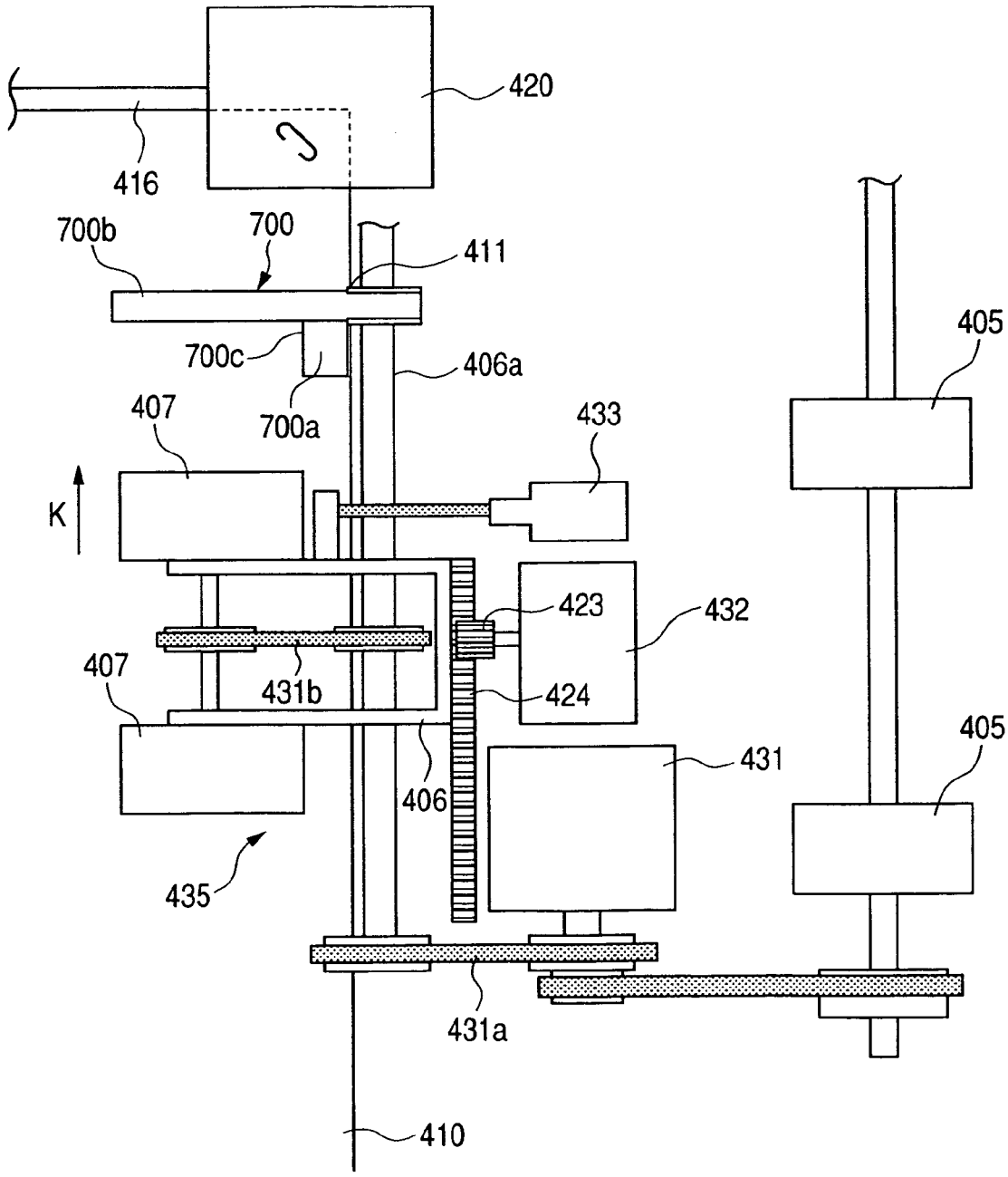
FIG. 20 is a schematic plan view of a driving mechanism portion for the offset roller and conveying roller of the sheet processing apparatus.

In FIG. 20, a side edge positioning wall (side edge regulating member) 416 as side edge positioning means is a wall which provides the aligning position reference of the edge portion of the sheet S in a direction (hereinafter referred to as the width direction) intersecting with the sheet conveying direction. A stapler unit 420 is disposed near the side edge positioning wall 416 of the treatment tray 410, and is adapted to effect staple treatment on a sheet bundle formed on the treatment tray 410. An offset roller 407 is adapted to be moved in the width direction by the driving of an offset motor 432 through a pinion 423 and a rack 424, and be capable of approaching the side edge positioning wall 416.

Design is made such that when the offset roller 407 approaches the side edge positioning wall 41.6, the sheet S rammed against a sheet trailing edge stopper 411 and aligned in the conveying direction by the rotation of the offset roller 407 is driven to move to the side edge positioning wall 416 by the offset roller 407 with the aid of the frictional force of the offset roller 407, by the offset roller 407 stopped from rotating and remaining in contact with the sheet S being moved in the width direction of the sheet (the direction indicated by the arrow K, whereby the positioning of the sheet in the width direction is effected.

Figure 21:
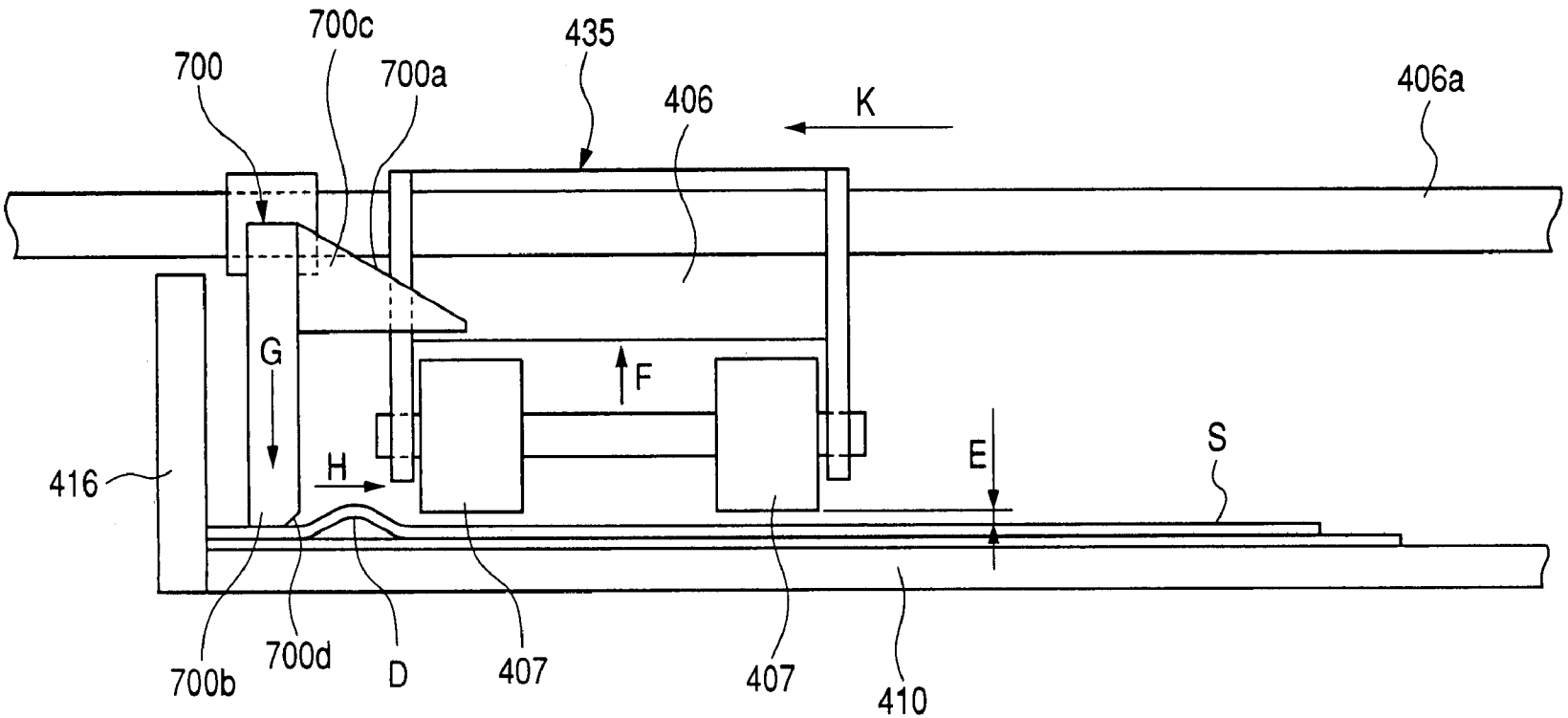
FIG. 21 is a view corresponding to FIG. 20 as it is seen from the left side, and showing the relation between an offset roller unit and a sheet holding-down member.

The sheet S is guided by the guide surface 700*d* of a sheet holding-down member 700 as pressing means shown in FIGS. 20 and 21 immediately before it abuts against the side edge positioning wall 416, and goes into between a pressing piece 700*b* and the treatment tray 410 and abuts against the side edge positioning wall 416. The guide surface 700*d* is an inclined surface approaching the treatment tray 410 as it approaches the side edge positioning wall 416.

Incidentally, unlike FIG. 20 in which the offset rollers 407 are disposed outside the offset roller arm 406, the offset rollers 407 are disposed inside the offset roller arm 406 in FIG. 21, and FIGS. 24A-24C, 25A, 25B, 26A and 26B which will be described later. But this difference in construction is merely a difference simply in design. There is no difference in function and action of the present embodiment whether the offset rollers 407 are disposed inside or outside the offset roller arm 406.

The sheet holding-down member 700, as shown in FIGS. 20 and 21, is rotatably provided on a shaft 406*a*, and is also formed with, for example, the pressing piece 700*b* which is a pressing portion for pressing the sheet from gravity, and for example, a floating piece 700*c* which is a floating portion formed with a slope 700*a* for receiving the underside of an offset roller arm 406.

The offset roller 407 moves the sheet S by a predetermined distance and rams it against the side edge positioning wall 416, and thereafter further conveys the sheet S by about 5 mm or more with the fact that the sheet S is being skew-fed in the image forming apparatus main body 500 taken into account.

Thereby, a loop is formed in the side edge portion of the sheet S rammed against the side edge positioning wall 416. The sheet holding-down member 700 is more or less pushed up by this loop. The offset roller 407 is still moved in a direction toward the side edge positioning wall 416, whereby as shown in FIG. 21, the underside of the offset roller arm 406 rides onto the slope 700*a* of the sheet holding-down member 700, and floats up in the direction indicated by the arrow F and is gradually spaced apart (E) from the sheet S.

At the same time, a load corresponding to the weight of an offset roller unit (406, 407, 431*b*, etc.) 435 itself by the offset roller arm 406 having ridden onto the upper portion of the sheet holding-down member is applied to the sheet holding-down member 700 which has held down the sheet S with the gravitational force of the sheet holding-down member 700, and the force with which the sheet holding-down member 700 urges the side edge portion of the sheet against the treatment tray 410 is increased.

Since as described above, the offset roller 407 floats up from the sheet and also, the force with which the sheet holding-member 700 urges the vicinity of the side edge of the sheet against the treatment tray 410 is increased, the above-mentioned loop D is opened in the direction indicated by the arrow H with the vicinity of the side edge of the sheet fixed. As the result, the sheet has its side edge reliably made to abut against the side edge positioning wall 416 and reliably aligned and also, has its skew feed in the width direction of the sheet corrected.

Description will hereinafter be made of the fact that the sheet processing apparatus 400 of the present embodiment is designed to be capable of forming the above-mentioned loop in the sheet always in the same fashion irrespective of the width size of the sheet.

As previously described, the sheet processing apparatus 400 of the present embodiment is designed such that the offset roller 407 moves the sheet S in a direction (the width direction of the sheet) intersecting with the sheet conveying direction of the image forming apparatus main body and rams the sheet S against the side edge positioning wall 416, and loops (flexes) the sheet S near the sheet holding-down member 700 to thereby correct the skew feed of the sheet in the width direction.

Now, design is made such that the sheet is fed into the sheet processing apparatus 400 with the center of the width of the sheet made coincident with the center of the width of the conveying path. As it were, design is made such that the sheet is conveyed with the center as a reference. On the other hand, as regards the amount of movement of the offset roller 407 in the width direction of the sheet, the distance from the center of the width of the sheet (the center of the width of the conveying path until the offset roller unit (406, 407, 431*b*, etc.) 435 rides onto the slope 700*a* of the sheet holding-down member 700 is normally the same irrespective of the width size of the sheet. Therefore, if the alignment of the sheet in the width direction thereof is effected with the offset roller 407 made to stand by at the center of the width of the sheet, the following inconvenience will occur.

That is, the larger is the width size of the sheet, nearer to the side edge positioning wall 416 is the side edge of the sheet. On the other hand, the amount of movement of the offset roller 407 in the width direction of the sheet is normally the same irrespective of the width size of the sheet, as previously described. Therefore, for example, a wide sheet like a sheet of a large size is long in the time during which it is formed with a loop after it has been brought into abutment against the side edge positioning wall 416, and is formed with a loop larger than in a sheet having a width narrower than that of the sheet of a large size, and is pushed onto the treatment tray 410 by the sheet holding-down member 700 to thereby cause jam, and this leads to the possibility that the side edge of the sheet cannot be aligned.

Figure 22A:
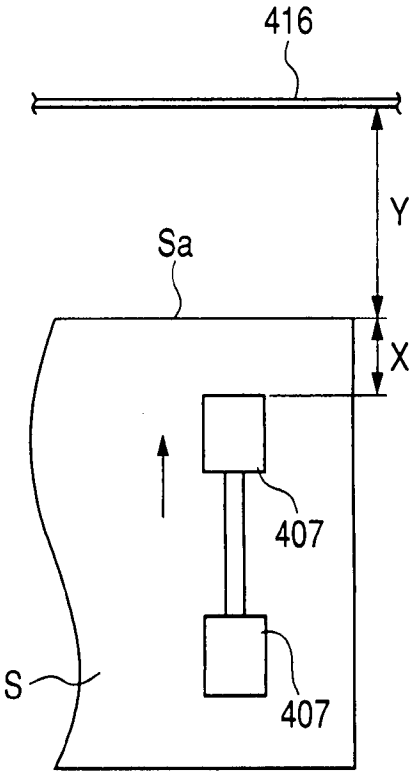
FIGS. 22A, 22B and 22C show a case where the standby position of the offset roller for a sheet fed to the sheet processing apparatus with the center of the width of the sheet made coincident with the center of the width of a conveying path is set to a position separate by a predetermined distance from the side edge of the sheet.
Figure 22B:
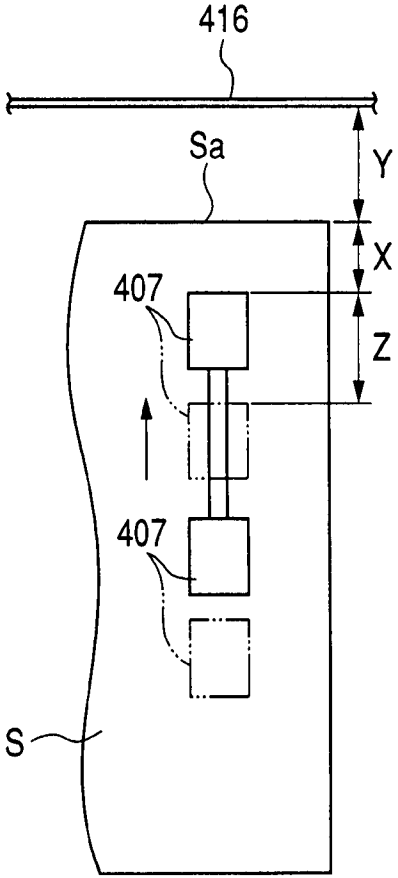
Figure 22C:
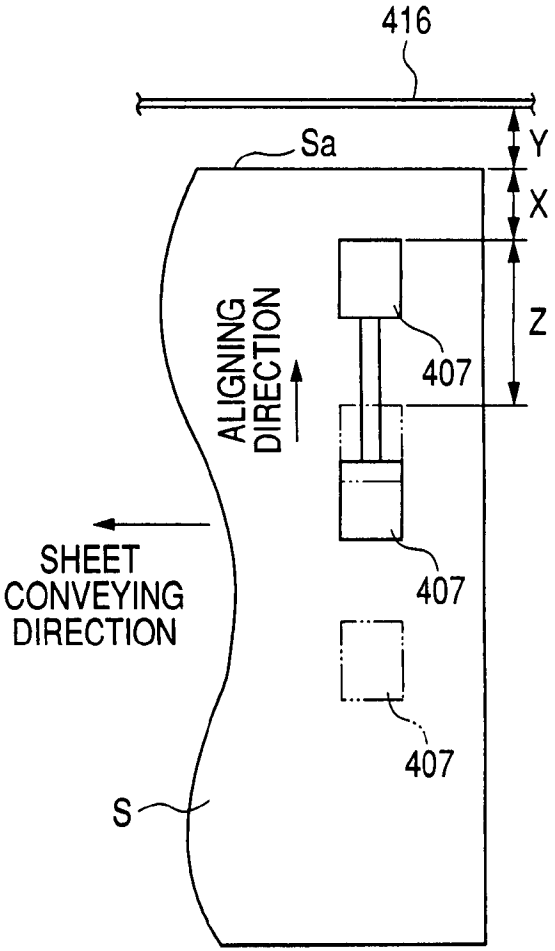

So, the offset roller 407 in the sheet processing apparatus 400 of the present embodiment, as shown in FIGS. 22A, 22B and 22C, is adapted to stand by at a position (X) substantially constant from the side edge Sa of each sheet, irrespective of the sheet width. This position is a position at which the offset roller contacts with the sheet and therefore, is referred to as the contact position. Therefore, even if the distance (Y) until the side edge of the sheet is caused to abut against the side edge positioning wall 416 differs, the amount of loop formed during the time from after the side edge of the sheet has abutted against the side edge positioning wall 416 until the offset roller unit (406, 407, 431*b*, etc.) 435 rides onto the slope 700*a* of the sheet holding-down member 700 and the offset roller 407 separates from the sheet can be made substantially the same irrespective of the width size of the sheet. As the result, the sheet processing apparatus 400 of the present embodiment can accomplish stable side edge alignment irrespective of the width size of the sheet, and can improve side edge aligning accuracy.

It is preferable that the value of the above-mentioned X be made more or less greater as the width size of the sheet becomes larger. That is, when the width size of the sheet is large, the sliding area of the sheet increases and the sliding resistance thereof is great and therefore, during the time until the side edge of the sheet is caused to abut against the side edge positioning wall 416 by the offset roller 407, the offset roller 407 sometimes more or less slip relative to the sheet, and there occurs a case where the amount of loop becomes small and the width alignment of the sheet cannot be effected accurately. So, the amount by which the offset roller 407 slips relative to the sheet is taken into account and the value of X is made more or less great in accordance with the width size of the sheet, whereby the amount of loop of the sheet can be secured and the width aligning accuracy of the sheet can be more improved.

Figure 23A:
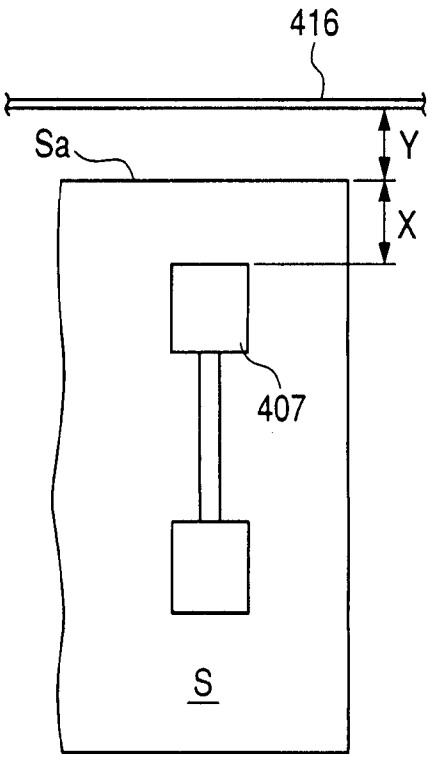
FIGS. 23A, 23B and 23C show a case where the standby position of the offset roller for a sheet fed to the sheet processing apparatus with the side edge of the sheet adjusted to one side of the conveying path is set to a position separate by a predetermined distance from the side edge of the sheet.
Figure 23B:
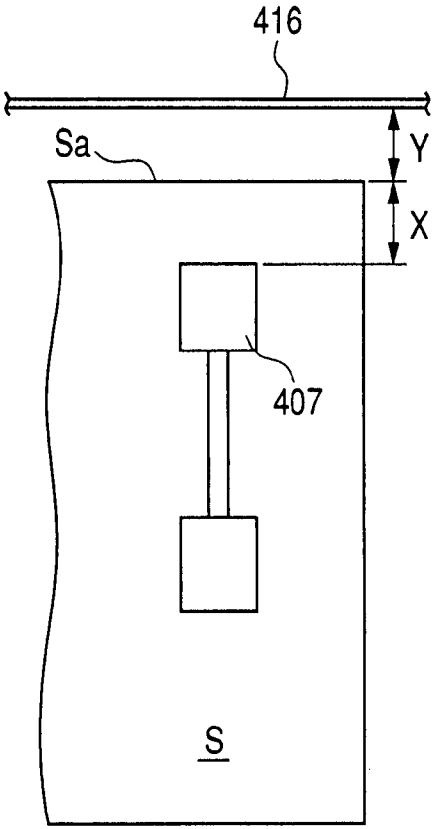
Figure 23C:
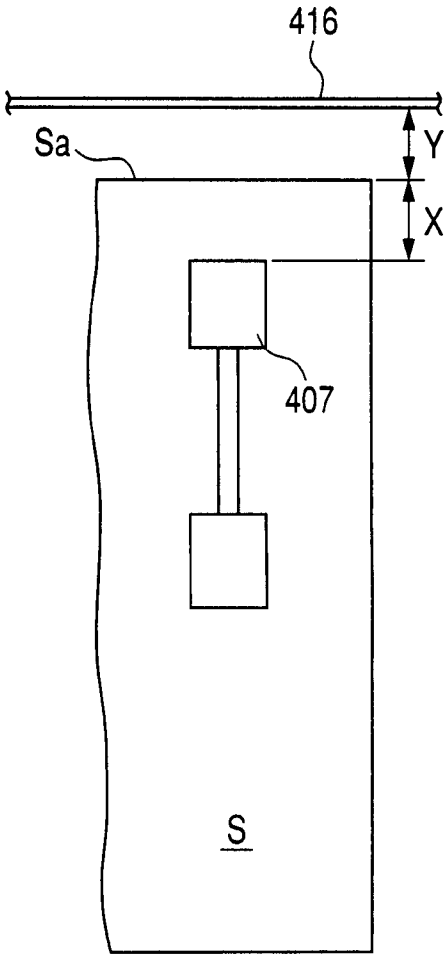

The foregoing description has been made of a case where the sheet is conveyed to the sheet processing apparatus 400 with the center of the width of the sheet coincident with the center of the width of the conveying path, but as shown in FIGS. 23A, 23B and 23C, in the case of a sheet conveyed to the sheet processing apparatus 400 with the side edge of the sheet made coincident with one side of the conveying path (so-called one side reference), the distances (Y) in FIGS. 23A to 23C are the same irrespective of the width size of the sheet.

In any case, it is preferable that the offset roller 407, immediately before it contacts with the sheet, be at a position of the distance X from the side edge Sa of the sheet, as shown in FIGS. 22A to 22C and FIGS. 23A to 23C.

The description of the sheet after treating operation will be continued below.

Figure 24A:
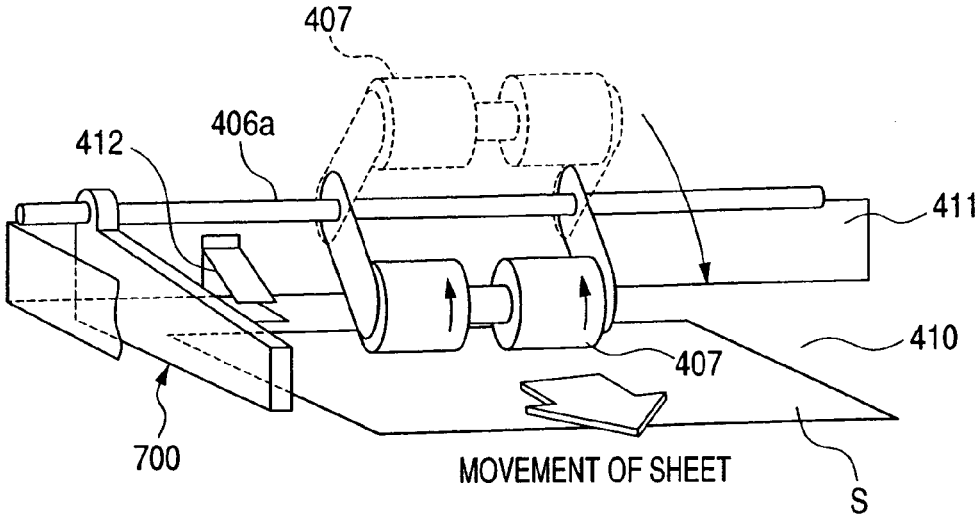
FIGS. 24A, 24B and 24C are views for illustrating the operation of the offset roller and the resultant movement of the sheet in the sheet processing apparatus of FIG. 20.
Figure 24B:
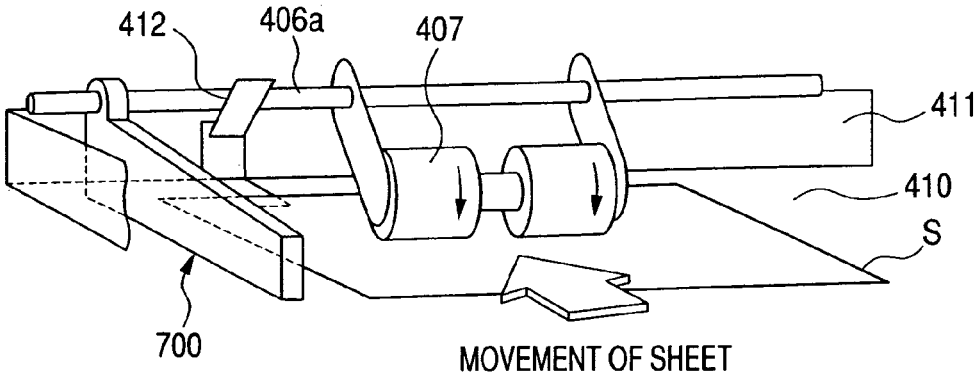

The sheet discharged onto the treatment tray 410 is conveyed to the stack tray 421 (see FIGS. 5 to 7) side by the offset roller 407 rotated in the sheet conveying direction, as shown in FIG. 24A, and thereafter is returned to the sheet trailing edge stopper 411 by the reverse rotation of the offset roller 407, as shown in FIG. 24B, and has its trailing edge rammed against the sheet trailing edge stopper 411 and has its trailing edge aligned.

Figure 24C:
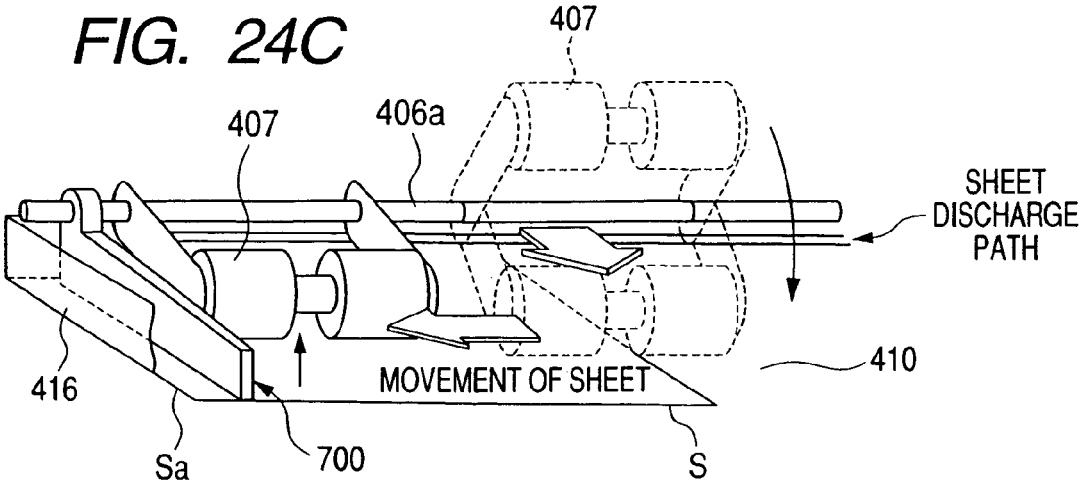

Thereafter, as shown in FIG. 24C, in a state in which the offset roller 407 is grounded to the sheet S, the offset roller 407 is moved to the side edge positioning wall 416 along the shaft 406*a*, whereby the side edge Sa of the sheet S in the width direction thereof is pushed against the side edge positioning wall 416, and the alignment of the sheet S in the width direction thereof is effected.

Figure 25A:
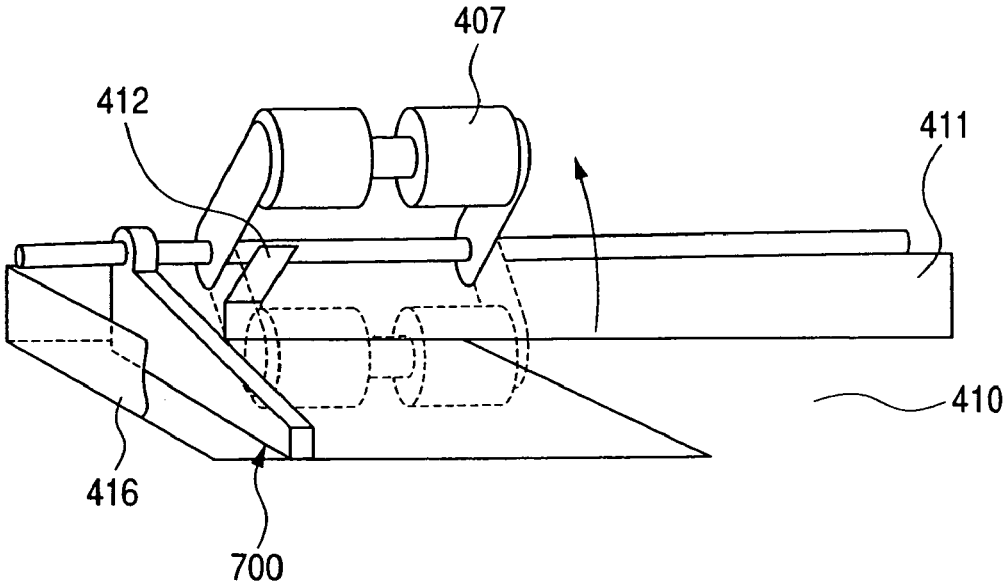
FIGS. 25A and 25B are views for illustrating the operation of the offset roller and the resultant movement of the sheet in the sheet processing apparatus of FIG. 20.
Figure 25B:
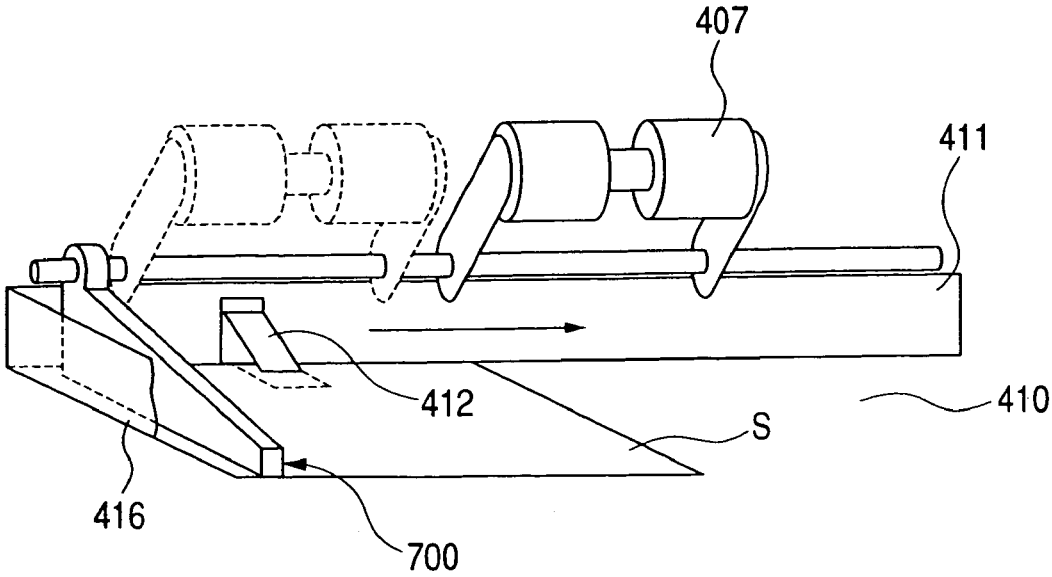

On the other hand, in FIG. 9, a sheet clamp member 412 is adapted to hold down the trailing edge portion of the aligned sheet S from above it against the treatment tray 410 by the biasing force of biasing means (not shown). After the alignment of the trailing edge of the sheet has been effected, the offset roller 407 is raised by the pickup solenoid 433, as shown in FIG. 25A, whereafter the sheet clamp member 412 holds down the aligned sheet S from above it, as shown in FIG. 25B. Thereby, the sheet S discharged earlier onto the treatment tray 410 is held at a predetermined position without being conveyed with and by sheets S successively fed thereafter.

Figure 26A:
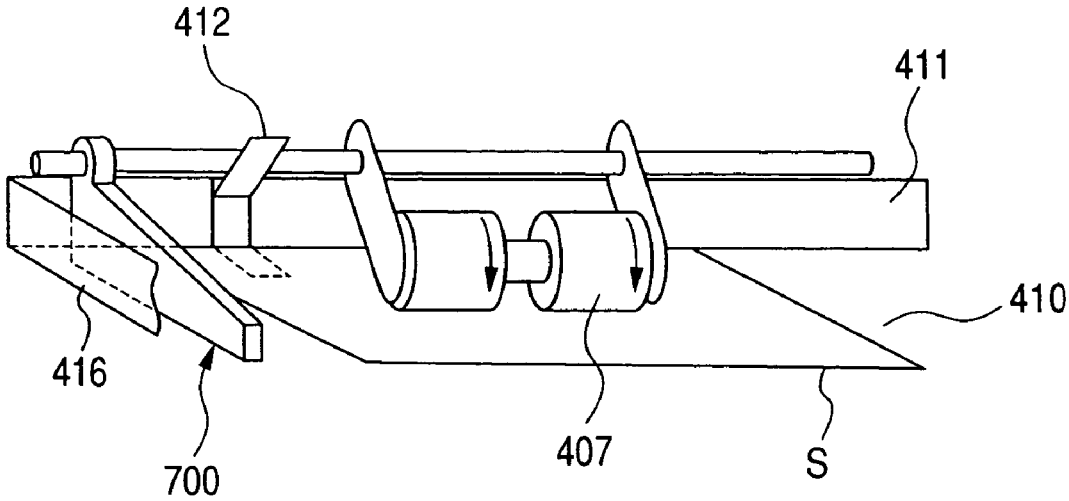
FIGS. 26A and 26B are views for illustrating the operation of the sheet clamp member in the sheet processing apparatus of FIG. 20.
Figure 26B:
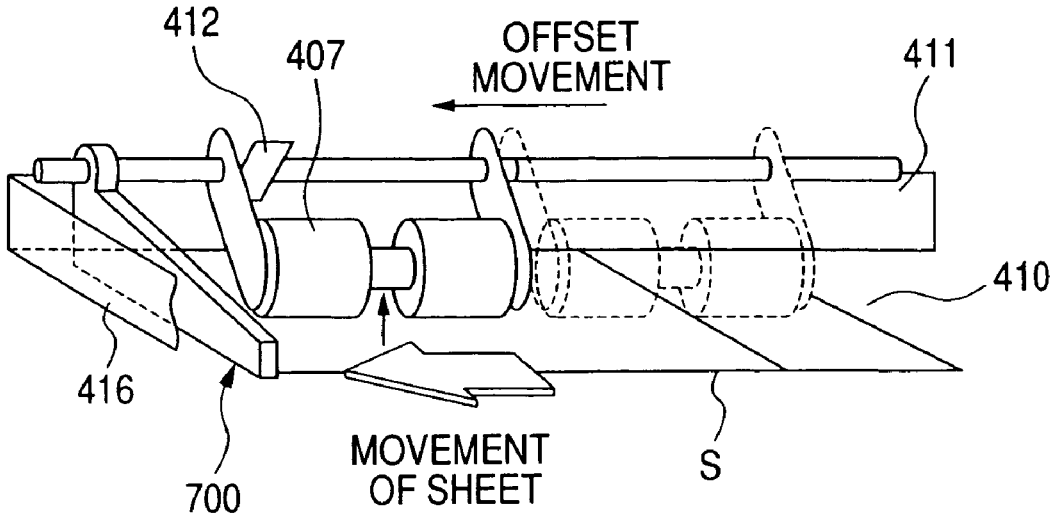

This sheet clamp member 412 is held at an upwardly pivotally moved position as shown in FIG. 26A so as to be capable of receiving the sheet S while the offset roller 407 is reversely rotated. Also, the sheet clamp member 412, when the sheet S is being moved in the width direction together with the offset roller 407 in order to align the trailing edge of the sheet, is held at an upwardly pivotally moved position as shown in FIG. 26B so as not to become the load of the movement of the sheet S.

Also, in FIG. 9, a sheet bundle discharging member 413 is adapted to discharge a treated sheet bundle onto the stack tray 421. This sheet bundle discharging member 413 pivotally movably holds the sheet clamp member 412 and also, is adapted to move the aligned sheet bundle or the sheet bundle aligned and stapled by the stapler unit 420 toward the stack tray 421 provided downstream of the treatment tray 410 as shown in FIG. 13 in a state in which the sheet bundle is held by the sheet clamp member 412.

The discharging of the sheet bundle in the present embodiment is similar to that in the afore described embodiment described with reference to FIGS. 9 and 13 and therefore, need not be described.

Also, regarding the controlling portion in the present embodiment, portions similar to those in the afore described embodiment described with reference to FIG. 14 need not be described.

Again in the present embodiment, as shown in FIG. 14, the controlling portion (CPU 100) of the sheet processing apparatus 400, each time a sheet S is discharged from the image forming apparatus main body 500, grasps the size thereof and controls the offset motor 432 to thereby control the offset roller 407 so as to be moved by an amount conforming to the size of the sheet away from the sheet to a position corresponding to the contact position at which the offset roller 407 contacts with the sheet. Thereby, the offset roller 407 contacts with the sheet when it has been moved by an amount conforming to the width of the sheet being discharged onto the treatment tray 410, and is moved by a preset amount corresponding to the width of the sheet to thereby ram the sheet S against the side edge positioning wall 416. Further, the CPU 100 moves the offset roller 407 by a substantially constant amount toward the side edge positioning wall 416 irrespective of the width of the sheet, to thereby make the end surface of the sheet S form a loop and correct the skew feed of the sheet in the width direction thereof.

The sheet processing operation of the present embodiment will now be described with reference to flow charts shown in FIGS. 27 and 28.

In the following description of the flow charts, it is to be understood that the sheet is conveyed with the afore described center reference.

First, when the image forming operation of the image forming apparatus main body 500 is started, the CPU 100 (see FIG. 14) of the sheet processing apparatus 400 checks up whether a sheet discharging signal has been received from the image forming apparatus main body 500 (S100). At this time, the offset roller 407 stands by at a central position adjusted to the center reference of the sheet being conveyed. This position is referred to as the standby position. The position at which the offset roller 407 contacts with the sheet is referred to as the contact position. The position at a distance X from the side edge Sa of the sheet in FIGS. 22A to 22C is referred to as the contact position. In some cases, the standby position and the contact position are the same, and in some cases, the standby position and the contact position differ from each other.

Here, if the sheet discharging signal has been received (YES at S100), the CPU 100 turns the pickup solenoid 433 (see FIG. 20) on (S110), to thereby pull up the offset roller 407 supported by the offset roller arm 406, and moves it to the contact position (see FIGS. 24A and 22A to 22C) conforming to the size of the sheet by the offset motor 432. The case of FIG. 22A is an example of a case where the standby position and contact position of the offset roller 407 are coincident with each other. The case of FIG. 22B is an example of a case where the width size of the sheet is larger than in FIG. 22A, and the offset roller 407, when moved by a distance Z from the standby position indicated by broken lines, comes to be moved to the contact position which is a position at a distance X from the side edge Sa of the sheet. The case of FIG. 22C is an example of a case where the width size of the sheet is still larger than in FIG. 22B, and the offset roller 407, when moved by a distance Z longer than in the case of FIG. 22B from the standby position indicated by broken lines, comes to be moved to the contact position which is a position at a distance X from the side edge Sa of the sheet.

Next, the CPU 100 turns the conveying motor 431 (see FIG. 20) on (S120) so that the conveying roller 405 installed intermediately of the path can convey the sheet in the same direction as the sheet discharging direction of the image forming apparatus main body 500. Here, when the leading edge of the first sheet passes the entrance sensor 403 (see FIG. 6) to thereby turn the entrance sensor 403 on (YES at S130), the first sheet arrives at the conveying roller 405 and receives a conveying force from the conveying roller 405, and separates from the sheet discharging portion 208 (see FIG. 5) of the image forming apparatus main body 500 (YES at S140), and is delivered to the sheet processing apparatus 400.

Next, the CPU 100 conveys the sheet to the treatment tray 410 by the conveying roller 405 and yet, turns the pickup solenoid 433 off before the sheet completely leaves the conveying roller 405 (S150), and makes the offset roller 407 land on the sheet from gravity. Thereafter, as shown in FIG. 24A, the CPU 100 controls the conveying motor 431 and conveys the sheet S to a predetermined position on the downstream side with respect to the sheet conveying direction by the offset roller 407 (S160). When the sheet S is conveyed to the predetermined position on the downstream side with respect to the sheet conveying direction (YES at S160), the CPU 100 stops the rotation of the conveying motor 431 (S170) to thereby stop the conveyance of the sheet S.

Next, the CPU 100 turns the clamp solenoid 434 on at a point of time whereat the rotation of the offset roller 407 has been stopped (S180), and as shown in FIG. 24B, opens the sheet clamp member 412 installed near the trailing edge stopper 411. Thereafter, the CPU 100 rotatively controls the conveying motor 431 in a direction reverse to the conveying direction, and pulls back the sheet S from the predetermined position on the downstream side with respect to the sheet conveying direction by the offset roller 407 (S190), and causes the trailing edge of the sheet to abut against the trailing edge stopper 411.

The amount of rotation of the offset roller 407 when the trailing edge of the sheet is rammed against the trailing edge stopper 411 is set, with the skew feed of the sheet S occurring when it is conveyed from the image forming apparatus main body 500 taken into account, so that the sheet can be conveyed somewhat more than the distance from a switch back point at which the conveyance of the sheet S to the downstream side with respect to the sheet conveying direction is stopped to thereby pull back the sheet to the upstream side to the trailing edge stopper 411.

Next, the CPU 100 checks up the size of the discharged sheet by size information from the image forming apparatus main body 500 (S200), and calculates the amount of offset movement, i.e., the distance Y from the side edge of the sheet to the side edge positioning wall 416, plus a distance $\alpha$ (not shown) for forming a loop in the sheet, in conformity with the size of the discharged sheet (S210).

Then, the CPU 100 controls the offset motor 432 (see FIG. 20), and offset-moves the offset roller 407 to the side edge positioning wall 416 through the pinion 423 and the rack 424, as shown in FIG. 24C (S220). When the offset roller 407 is thus moved, the sheet S being in contact with the offset roller 407 is moved with the offset roller 407 toward the side edge positioning wall 416 by the frictional force of the offset roller 407.

At this time, the sheet clamp member 412 has been upwardly pivotally moved as shown in FIG. 26B so as not to become the load of the movement of the sheet S. Also, the sheet clamp member 412, even if it faces upwardly, is adapted not to interfere with the offset roller 407 and the offset roller arm 406.

Next, the offset roller 407, still after it has rammed the sheet S against the side edge positioning wall 416, is moved by the distance α at (S210) while somewhat sliding on the sheet S, and forms a loop in the side edge portion of the sheet S. Also, the offset roller 407 is moved toward the side edge positioning wall 416, whereby the offset roller unit 435 rides onto the slope 700*a* of the sheet holding-down member 700, whereby the offset roller is spaced apart from the sheet S substantially simultaneously with the spacing apart, the sheet holding-down member 700 receives the gravity of the offset roller unit 435 and presses the sheet against the treatment tray 410. Thereby, the sheet S has its loop released while being pressed against the treatment tray 410 by the sheet holding-down member 700, and the alignment of the side edge of the first sheet S is completed.

When the alignment of the first sheet S is thus completed, the CPU 100 turns the pickup solenoid 433 (see FIG. 20) on (S240), and raises the offset roller 407 as shown in FIG. 25A, and thereafter turns the clamp solenoid 434 (see FIG. 9) off (S250). Thereby, as shown in FIG. 25B, the sheet clamp member 412 is closed, and the aligned sheet S is nipped and held by the treatment tray 410. As the result, the sheet S discharged at first can be prevented from being conveyed to the downstream side with respect to the sheet conveying direction with and by the sheet discharged next.

Next, the CPU 100 controls the offset motor 432 to thereby return the offset roller 407 raised by the pickup solenoid 433 intactly to the home position which is the standby position described in connection with (S100), as shown in FIG. 25B (S260).

Thereafter, the CPU 100 checks up whether the sheet S placed on the treatment tray 410 is the last sheet corresponding to the last page of the original to be copied (S270), and if it judges on the basis of information sent from the image forming apparatus main body 500 that the sheet S is not the last sheet (NO at S270), the CPU 100 returns to S100, where it receives a sheet discharging signal sent next from the image forming apparatus main body 500, and repeats the afore described flow until the last sheet S is contained in the treatment tray 410.

Thereby, each time a sheet S is discharged from the image forming apparatus main body 500, the controlling portion (CPU) of the sheet processing apparatus 400 grasps the width size of that sheet S and also, calculates an offset standby position and an amount of offset suited for that sheet S, and can convey the sheet S contacted with by the offset roller 407 by a substantially constant amount irrespective of the size of each sheet to thereby align it with the side edge positioning wall 416.

On the other hand, if the CPU 100 judges that the sheet S is the last sheet (YES at S270), it means that a sheet bundle corresponding to the original to be copied is formed on the treatment tray 410 and therefore, next, the CPU 100 checks up whether staple treatment is selected (S280), and if staple treatment is selected (YES at S280), the stapler unit 420 is driven to thereby execute the staple treatment (S290).

Next, if the staple treatment is not selected (NO at S270), or after the staple treatment has been completed, the CPU 100 controls the sheet bundle discharging motor 430 (see FIG. 9) to thereby advance the sheet bundle discharging member 413 (see FIGS. 9 and 13) gripping the sheet bundle by the sheet clamp member 412 toward the stack tray 421, and moves the sheet bundle SA to discharge it (S300).

The CPU 100 operates the clamp solenoid 434 to thereby release the gripping of the sheet bundle by the sheet clamp member 412, and discharges the sheet bundle onto the stack tray 421 (S310), and controls the sheet bundle discharging motor 430 to thereby return the sheet bundle discharging member 413 to its home position (S320). Further, thereafter, the CPU 100 stops the conveying motor 431 to stop the rotation of the conveying roller 405 and the offset roller 407 (S330), and turns the pickup solenoid 433 off (S340) to thereby lower the offset roller 407, thus completing a series of treatments.

Figure 27:
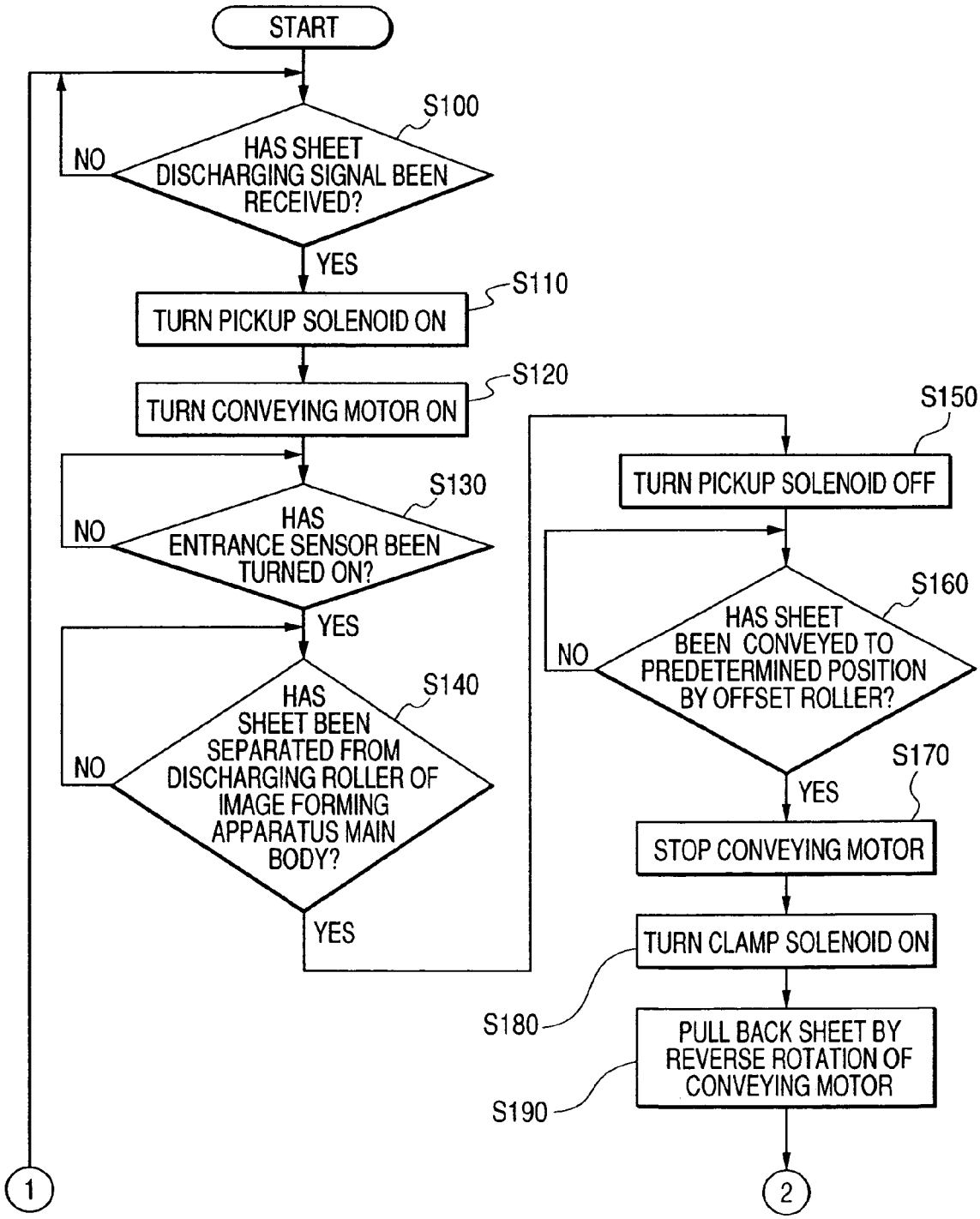
FIG. 27 is a flow chart illustrating a part of the sheet treating operation of the sheet processing apparatus.
Figure 28:
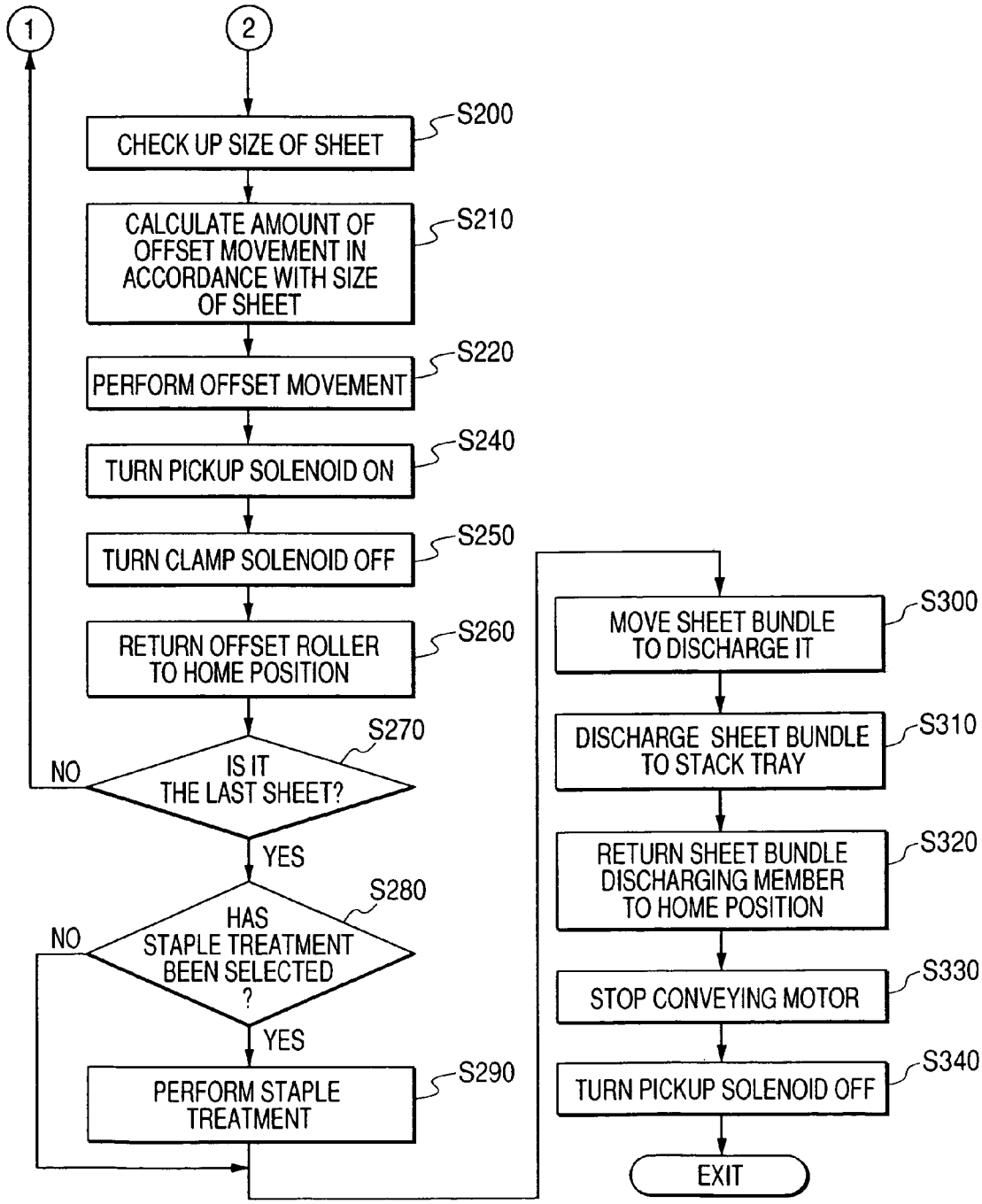
FIG. 28 is a flow chart continued from FIG. 27.

While in the present embodiment, the CPU effects control while reading out a program written on the RAM (or the ROM) shown in the flow charts of FIGS. 27 and 28, a similar effect will also be obtained if design is made such that the processing in the control program is carried out by hardware.

Also, while in the present embodiment, the sheet holding-down member 700 is adapted to press the sheet against the treatment tray 410 substantially at the same timing as that at which the offset roller 407 is spaced apart from the sheet, of course, the shape of the slope 700*a* of the sheet holding-down member 700 may be changed and the offset roller 407 may be spaced apart from the sheet after the sheet holding-down member 700 has been caused to press by the offset roller unit 435 (see FIG. 20).

As described above, in the sheet processing apparatus 400, design is made such that the offset roller 407 for conveying the sheet contacts with the upper side of the sheet and moves the sheet in the direction intersecting with the sheet conveying direction of the image forming apparatus A to thereby ram the sheet against the side edge positioning wall 416, form a loop and correct the skew feed of the side edge of the sheet, and further, is moved in the same direction and rides onto the floating piece 700*c* (slope 700*a*) of the sheet holding-down member 700, and becomes spaced apart from the sheet to thereby release the loop of the sheet. Also, design is made such that the offset roller 407 rides onto the slope 700*a* of the sheet holding-down member 700 to thereby release the loop of the sheet and substantially simultaneously therewith, the sheet holding-down member 700 presses the sheet against the treatment tray 410.

While at (S110) in the above-described flow chart, the offset roller 407 is moved to the contact position, the offset roller 407 may be kept at the standby position without being moved to the contact position, and at (S210), the contact position may be calculated.

The sheet processing apparatus 400 of the above-described embodiment is designed such that a loop is formed in the sheet by the offset roller 407 and substantially at the same timing as that at which the offset roller 407 is spaced apart from the sheet, the sheet holding-down member 700 presses the sheet against the treatment tray 410, but when it is not necessary to space the offset roller 407 apart from the sheet as when the loop is not formed or when the loop is small, use may be made, for example, of a sheet holding-down member 710 which is pressing means, as shown in FIGS. 29 to 33A and 33B.

Figure 29:
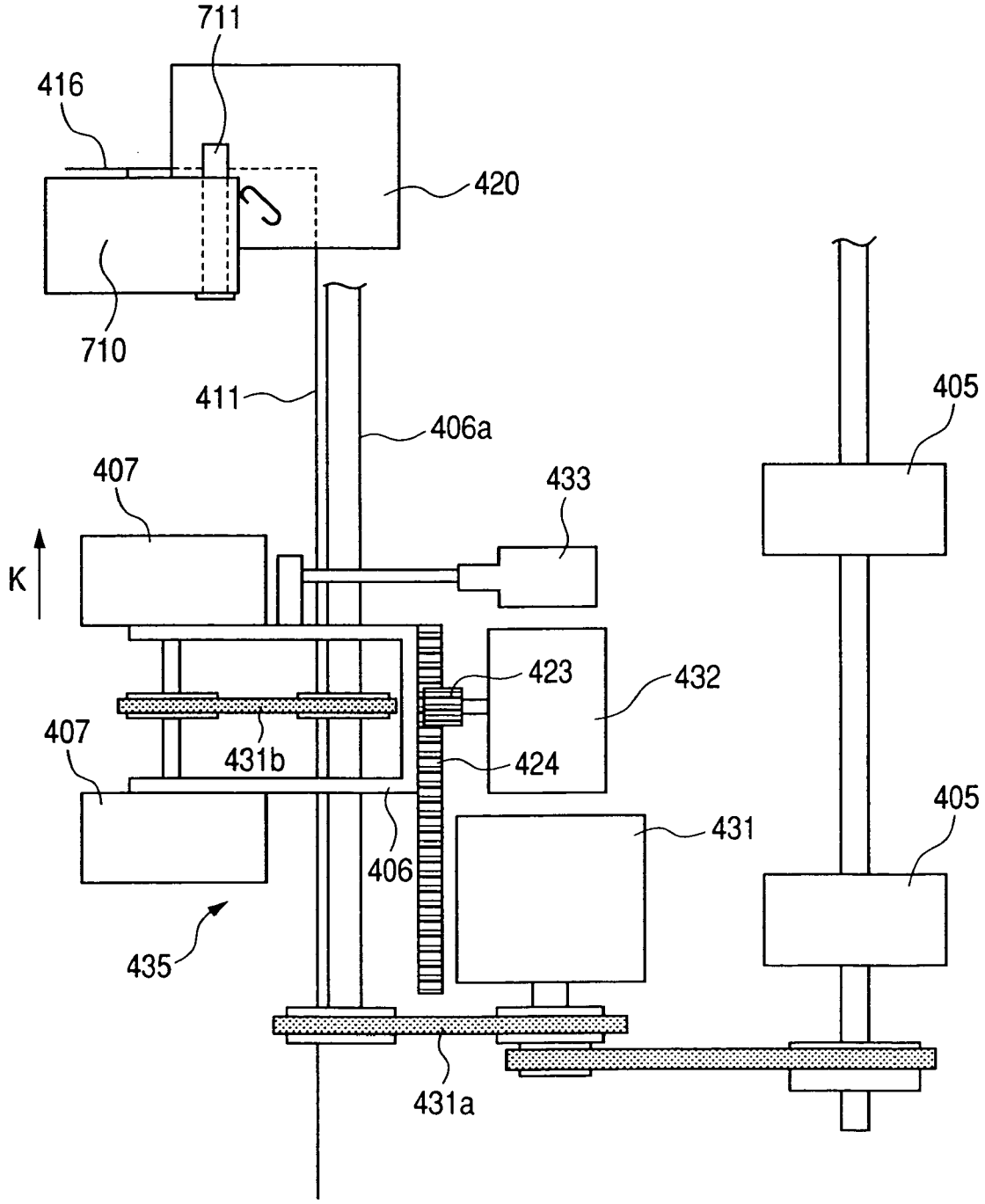
FIG. 29 is a schematic plan view of a driving mechanism portion for a sheet holding-down member, an offset roller and a conveying roller in another embodiment.
Figure 30:
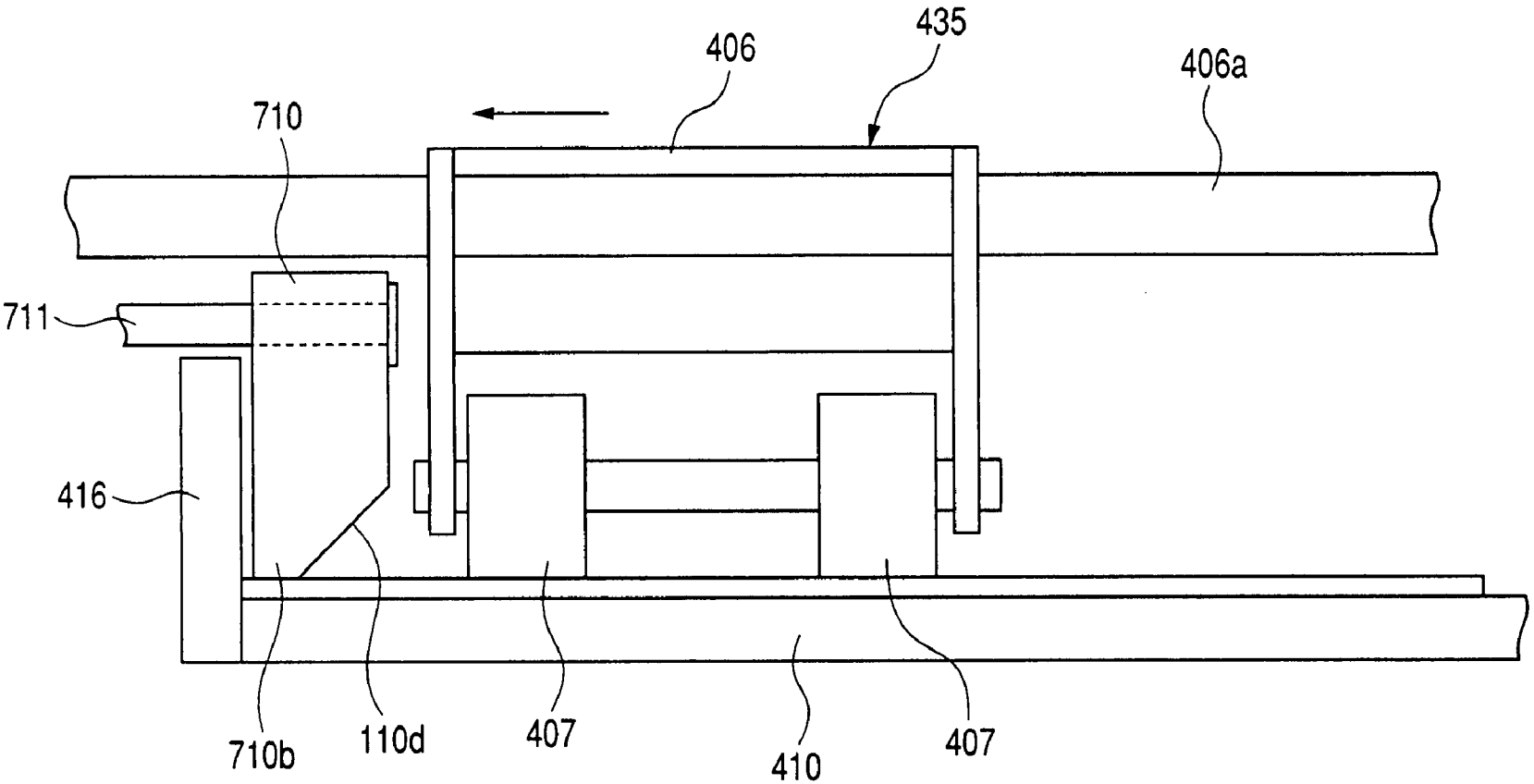
FIG. 30 shows the relation between a sheet holding-down member and an offset roller unit in another embodiment.

Incidentally, unlike FIG. 29 in which the offset rollers 407 are disposed outside the offset roller arm 406, the offset rollers 407 are disposed inside the offset roller arm 406 in FIGS. 30, 31A-31C, 32A, 32B, 33A and 33B. But this difference in construction is merely a difference simply in design. There is no difference in function and action of the present embodiment whether the offset rollers 407 are disposed inside or outside the offset roller arm 406.

This sheet holding-down member 710 is provided on a supporting shaft 711 provided on a fixed member (not shown), for rotation in the sheet conveying direction. This sheet holding-down member 710 is also formed with a guide surface 710*d* for guiding the sheet between, for example, a pressing piece 710*b* which is a pressing portion for pressing the sheet from gravity and the treatment tray 410. The offset roller 407 may be provided for rotation relative to the shaft 406*a*.

Figure 31A:
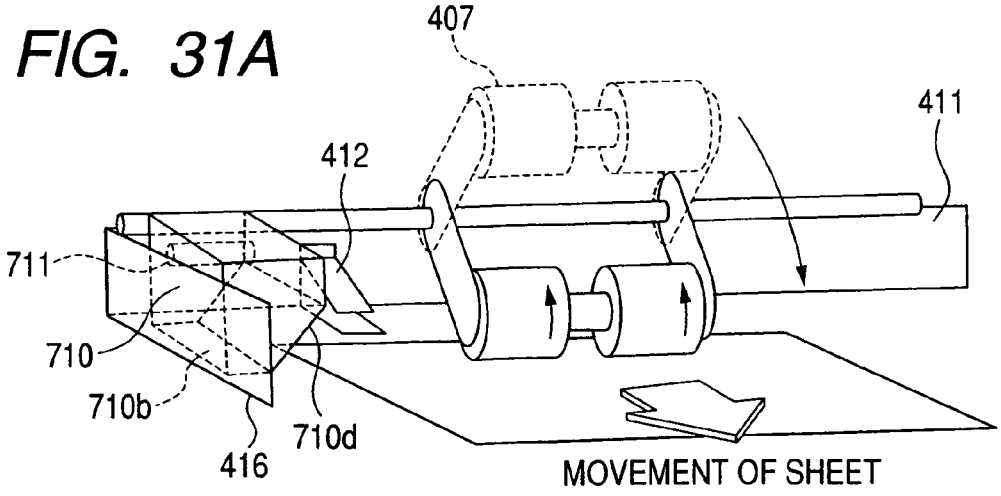
FIGS. 31A, 31B and 31C are views for illustrating the operation of an offset roller and the resultant movement of a sheet in a sheet processing apparatus provided with another sheet holding-down member.
Figure 31B:
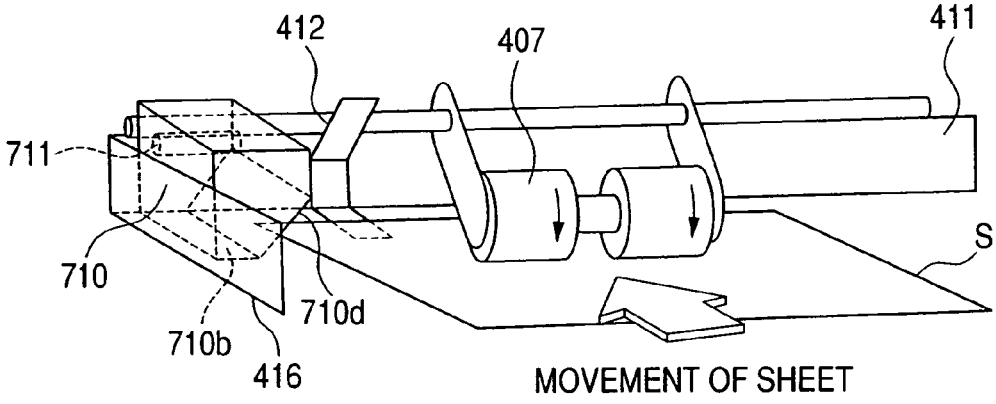

The operation of chiefly the sheet holding-down member 710 will hereinafter be described. The sheet discharged onto the treatment tray 410, as shown in FIG. 31A, is conveyed to the stack tray side by the offset roller 407 rotated in the sheet conveying direction, and thereafter is returned to the sheet trailing edge stopper 411 by the reverse rotation of the offset roller 407, as shown in FIG. 31B, and thereafter has its trailing edge rammed against the sheet trailing edge stopper 411 and is aligned thereby.

Figure 31C:
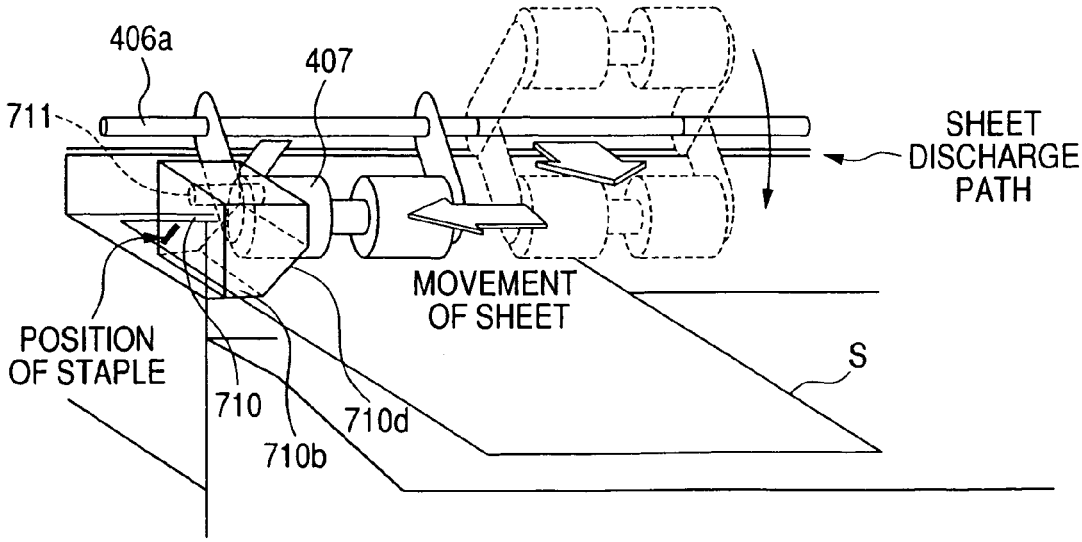

Thereafter, as shown in FIG. 31C, the offset roller 407 as it is grounded to the sheet S is moved to the side edge positioning wall 416 side along the shaft 406*a*, whereby the axial end portion of the sheet S is moved along the guide surface 710*d* of the sheet holding-down member 710, and is pressed against the side edge positioning wall 416 while being pushed by the pressing piece 710*b* of the sheet holding-down member 710, and the alignment of the sheet S in the width direction thereof is effected. By the sheet holding-down member 710 being thus installed, the sheet can always be pressed during the alignment of the sheet in the width direction thereof and therefore, the wild behavior or the like of the sheet during the alignment thereof becomes rare, and the aligning property of the sheet bundle can be improved.

Figure 32A:
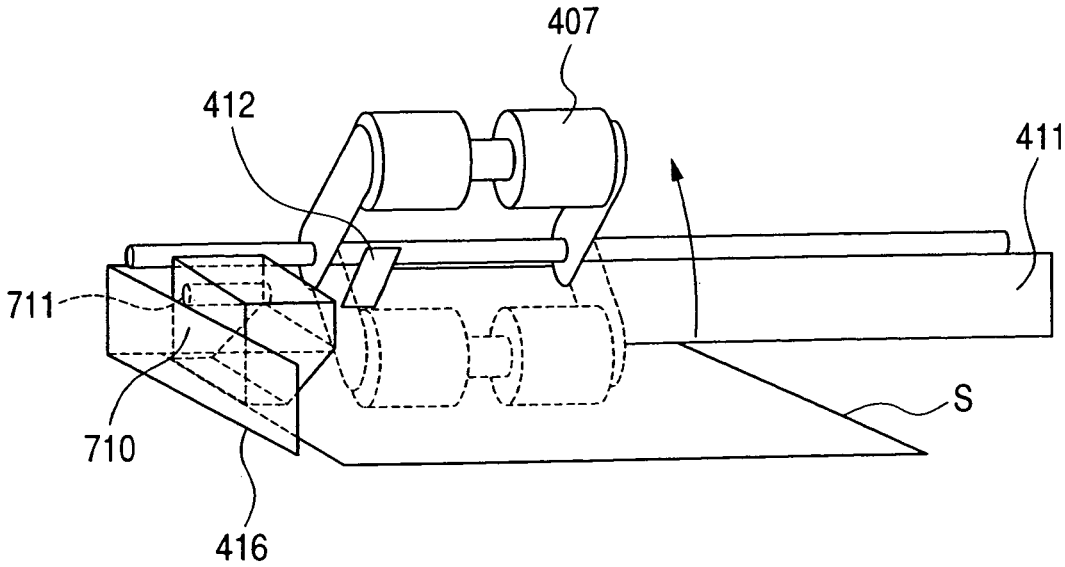
FIGS. 32A and 32B are views for illustrating the operation of the offset roller and the resultant movement of the sheet in the sheet processing apparatus of FIG. 29.
Figure 32B:
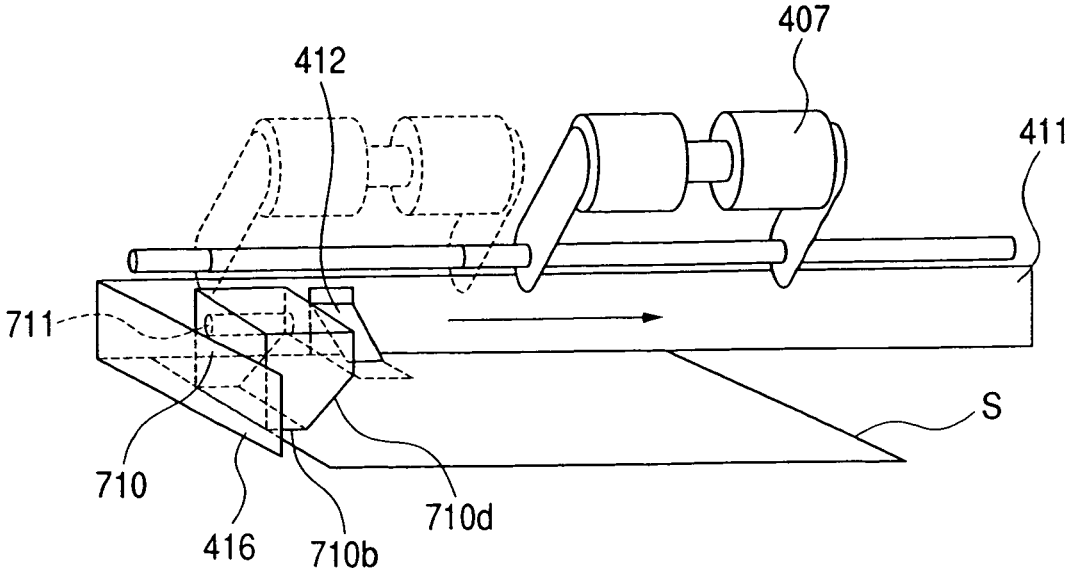

Design is made such that as shown in FIG. 32A, the offset roller 407 is raised by the pickup solenoid 433 shown in FIG. 29, whereafter the aligned sheet S is held down from above it by the sheet clamp member 412, as shown in FIG. 32B. Thereby, the sheet S discharged earlier onto the treatment tray 410 can be held at a predetermined position without being conveyed with and by sheets successively conveyed thereafter.

Figure 33A:
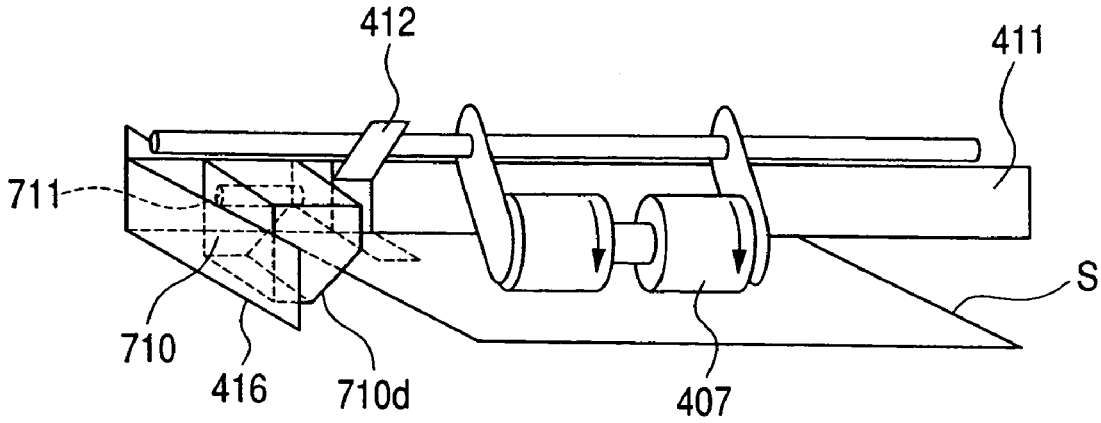
FIGS. 33A and 33B are views for illustrating the operation of a sheet clamp member in the sheet processing apparatus of FIG. 29.
Figure 33B:
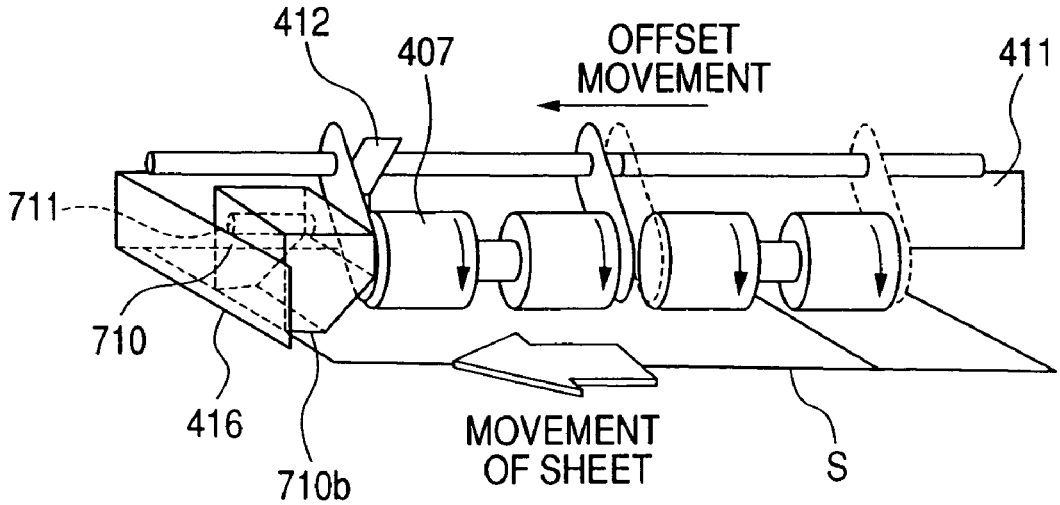

This sheet clamp member 412, when the offset roller 407 is being reversely rotated, is upwardly pivotally moved as shown in FIG. 33A so as to be capable of receiving the sheet S, and when the sheet S is moved in the width direction with the offset roller 407 in order to have its edge portion aligned, the sheet clamp member 412 is upwardly pivotally moved as shown in FIG. 33B so as not to become the load of the movement of the sheet S.

As shown in FIG. 13, the sheet clamp member 412 is conveyed toward the stack tray 421 which is another sheet stacking means provided downstream of the treatment tray 410, while holding an aligned sheet bundle or a sheet bundle stapled after aligned.

Further, when thereafter the sheet bundle arrives at the force end portion of the treatment tray 410 which is a sheet discharging position indicated by solid line in FIG. 13, the hold of the sheet bundle SA by the sheet clamp member 412 is released on the stack tray 421 so that the sheet bundle SA may be discharged onto the stack tray 421.

As described above, the sheet can always be pressed by the sheet holding-down member 710 during the alignment of the sheet in the width direction thereof and therefore, the wild behavior of the sheet during the alignment becomes rare, and the aligning property of the sheet bundle can be improved.

Thus, the sheet processing apparatus, if provided with the above-described sheet holding-down member 710, is designed such that the side edge portion of the sheet moved by the offset roller 407 is guided by the guide surface 710*d* formed on the sheet holding-down member 710 and therefore, even if the sheet is a curled sheet, the sheet can be guided by the guide surface 710*d* and advanced to into the lower portion of the sheet holding-down member 710, and can be caused to abut against the side edge positioning wall 416 in a state in which it is pressed against the treatment tray 410 by the sheet holding-down member 710 and flattened, and the aligning accuracy of the side edge of the sheet can be improved. The sheet processing apparatus also achieves a similar effect when it is provided with the afore described sheet holding-down member 700.

Also, in the previous description, the case in that the sheet processing apparatus is provided with the sheet holding-down member 710 and the case in that the sheet processing apparatus is provided with the sheet holding-down member 700 are described. However, the sheet processing apparatus may be provided with both of the sheet holding-down member 710 and the sheet holding-down member 700. In this case, the sheet holding-down member 700 can hold down the sheet while the sheet guide surface 710*d* can guide the side edge portion of the sheet more effectively and smoothly.

Also, in the description hitherto made, it is described that the side edge of the sheet is positioned after the upstream edge of the sheet has been caused to abut against the sheet trailing edge stopper 411 by the offset roller 407, but in a case where the afore described sheet holding-down member 710 is used, a similar effect will also be achieved if design is made such that the CPU of the controlling portion controls the sheet treating operation of the afore described offset roller, etc. so that the upstream edge of the sheet may be brought into abutment against the sheet trailing edge stopper 411 after the side edge of the sheet has been brought into abutment against the side edge positioning wall 416 and the side edge of the sheet has been positioned, by the offset roller 407.

Also, in the description hitherto made, description has been made of a case where design is made such that the CPU of the controlling portion provided in the sheet processing apparatus provided in the image forming apparatus controls the operation of the offset roller, etc., but the CPU of the controlling portion may be provided in the image forming apparatus main body, and design may be made such that the CPU controls the sheet treating operation of the afore described offset roller, etc.

The sheet processing apparatus of the present embodiment is designed such that the side edge portion of a sheet moved by moving means is guided to between the pressing means and the stacking means by an inclined portion formed on the pressing means and therefore, even if the sheet is a curled sheet, the sheet can be guided by the guide surface and be advanced into between the pressing means and the stacking means, and can be caused to abut against the side edge positioning means in a state in which it is pressed against the stacking means by the pressing means and is flattened, and the aligning property of the side edge can be improved.

The sheet processing apparatus of the present embodiment is designed such that the moving means having had brought the side edge of the sheet caused to abut against the side edge positioning means is spaced apart from the sheet by the floating portion of the pressing means and therefore, the pressing force of the pressing means against the sheet is increased, and the loop formed in the sheet can be opened with the position of the sheet caused to abut against the side edge positioning wall being hardly deviated and thus, the aligning accuracy of the side edge of the sheet can be improved.

The sheet processing apparatus of the present embodiment is designed such that after the upstream edge of the sheet has been aligned by the upstream positioning means, the side edge of the sheet is positioned by the side edge positioning means and therefore, can enhance the aligning accuracy of the side edge of the sheet. Also, it is designed such that the alignment of both of the upstream edge and side edge of the sheet can be effected by common moving means and therefore, the structure thereof can be simplified.

The sheet processing apparatus of the present embodiment is designed such that the moving means not only effects the alignment of the side edge of the sheet, but also performs the operation of discharging the sheet and therefore, the structure thereof can be simplified.

The sheet processing apparatus of the present embodiment is designed such that the moving means contacts with a position substantially constant from the side edge of each sheet, irrespective of the width of the sheet and therefore, even if the distance until the side edge of the sheet is caused to abut against the side edge positioning means differs depending on the size of the sheet, the distance by which the pressing means urges the side edge of the sheet against the side edge positioning means can be made substantially constant irrespective of the size of the sheet, and can enhance the side edge aligning accuracy of the sheet. Also, if the pressing means is provided with a floating portion, the amount of loop formed during the time until the moving means separates from the sheet can be made substantially the same irrespective of the width size of the sheet. As the result, the side edge aligning accuracy of the sheet can be enhanced.

In the sheet processing apparatus of the present embodiment, when the sheet is conveyed with its side edge as the reference, the contact position of the moving means is normally set at the same position and therefore, irrespective of the width size of the sheet, the moving means is adapted to stand by at a position substantially constant from the side edge of each sheet, and the distance by which the pressing means brings the side edge of the sheet into abutment against the side edge positioning means and then urges it against the latter can be made the same irrespective of the size of the sheet to thereby enhance the side edge aligning accuracy of the sheet. Also, if the pressing means is provided with a floating portion, the amount of loop formed during the time until the moving means separates from the sheet can be made substantially the same irrespective of the width size of the sheet. As the result, the side edge aligning accuracy of the sheet can be enhanced.

In the sheet processing apparatus of the present embodiment, when the distance between the side edge positioning means and the side edge of the sheet differs from a sheet to another, the contact position of the moving means contacting with the sheet is set at a position farther from the side edge positioning means as the spacing between the side edge positioning means and the side edge of the sheet is greater and therefore, even if the distance until the side edge of the sheet is caused to abut against the side edge positioning means differs depending on the size of the sheet, the distance by which the pressing means causes the side edge of the sheet to abut against the side edge positioning means and then urges it against the latter can be made substantially constant irrespective of the size of the sheet, and the side edge aligning accuracy of the sheet can be enhanced. Also, if the pressing means is provided with a floating portion, the amount of loop formed during the time until the moving means separates from the sheet can be made substantially the same irrespective of the width size of the sheet. As the result, the side edge aligning accuracy of the sheet can be enhanced.

In the sheet processing apparatus of the present embodiment, the contact position is set at a position to which is added an amount by which the moving means slips while it moves the sheet to the side edge positioning means and therefore, even if the moving means slips relative to the sheet, the side edge of the sheet can be reliably aligned to the side edge positioning means, and the aligning accuracy of the side edge can be enhanced.

While the invention has been described with reference to the structure disclosed herein, it is not confined to the details set forth and this application is intended to cover such modifications or changes as may come within the purpose of the improvements or the scope of the following claims.

What is claimed is:

1. A sheet processing apparatus comprising:

a first sheet stacking portion, which stacks a sheet thereon;

a second sheet stacking portion provided downstream of said first sheet stacking portion with respect to a sheet conveying direction;

sheet holding means for holding down the sheet stacked on said first sheet stacking portion from above; and a driving device, which moves said sheet holding means between a holding position for holding the sheet and a stop position provided downstream of the holding position with respect to the sheet conveying direction, said driving device moving said sheet holding means from the holding position to the stop position with said sheet holding means holding down the sheet from above; and hold releasing means for releasing a hold of the sheet by said sheet holding means, by said sheet holding means being engaged with said hold releasing means by a movement of said sheet holding means from the stop position to a discharging position in a direction opposite to the sheet conveying direction to discharge the sheet to said second sheet stacking portion at a discharging position spaced apart by a predetermined distance toward an upstream side from the stop position.

2. A sheet processing apparatus according to claim 1, wherein when the hold of the sheet by said sheet holding means is released by said hold releasing means, the sheet is stacked on said second sheet stacking portion with an aid of gravity of the sheet at the discharging position.

3. A sheet processing apparatus according to claim 1, wherein said sheet holding means has a sheet holding member movable between a first position for holding the sheet and a second position for releasing the hold of the sheet, and said hold releasing means moves said sheet holding member from said first position to said second position by the movement of said sheet holding means from the stop position to the discharging position.

4. A sheet processing apparatus according to claim 3, wherein said hold releasing means is a recess formed in a downstream side end portion of said first sheet stacking portion, and said sheet holding means has a lever portion movable in said recess, and wherein by the movement of said sheet holding means from the stop position to the discharging position, said lever portion is moved by a predetermined distance in said recess, and said lever portion abuts against a side wall of said recess, whereby said sheet holding member is moved from the first position to the second position.

5. A sheet processing apparatus according to claim 1, further comprising a stapler for stapling a sheet bundle stacked on said first sheet stacking portion, wherein said sheet holding means holds the sheet bundle stapled by said stapler.

6. An image forming apparatus comprising:

an image forming portion, which forms an image on a sheet; and a sheet processing apparatus, which processes the sheet having the image formed thereon by said image forming portion, wherein said sheet processing apparatus includes:

a first sheet stacking portion, which stacks thereon the sheet conveyed from said image forming portion;

a second sheet stacking portion provided downstream of said first sheet stacking portion with respect to a sheet conveying direction;

sheet holding means for holding down the sheet stacked on said first sheet stacking portion from above; and a driving device, which moves said sheet holding means between a holding position for holding the sheet and a stop position provided downstream of the holding position with respect to the sheet conveying direction, said driving device moving said sheet holding means from the holding position to the stop position with said sheet holding device holding down the sheet from above; and hold releasing means for releasing a hold of the sheet by said sheet holding means, by said sheet holding means being engaged with said hold releasing means by a movement of said sheet holding means from the stop position to a discharging position in a direction opposite to the sheet conveying direction to discharge the sheet to said second sheet stacking portion at the discharging position spaced apart by a predetermined distance toward an upstream side from the stop position.

7. A sheet processing apparatus comprising:

a sheet stacking portion, which stacks a sheet thereon;

a side edge regulating member provided on a side of said sheet stacking portion in a width direction intersecting with a sheet conveying direction for regulating the sheet stacked on said sheet stacking portion in the width direction;

sheet moving means for moving the sheet stacked on said sheet stacking portion in the width direction so that the sheet abuts against said side edge regulating member; and pressing means for pressing a side edge portion of the sheet abutting against said side edge regulating member against said sheet stacking portion, said pressing means being provided near said side edge regulating member for movement toward and away from said sheet stacking portion, and said pressing means having guide means for guiding the side edge portion of the sheet moved between said pressing means and said sheet stacking portion by said sheet moving means.

8. A sheet processing apparatus according to claim 7, wherein said sheet moving means includes:

a sheet conveying device, which performs forward rotation for conveying the sheet on said sheet stacking portion in the sheet conveying direction, and reverse rotation for conveying the sheet on said sheet stacking portion in a direction opposite to the sheet conveying direction; and a moving device, which moves said sheet conveying device in the width direction with said sheet conveying device being in contact with the sheet, so that the sheet abuts against said side edge regulating member.

9. A sheet processing apparatus according to claim 8, wherein said pressing means has a floating portion, which spaces said sheet conveying device apart from the sheet after said sheet conveying device has caused the sheet to abut against said side edge regulating member.

10. A sheet processing apparatus according to claim 8, further comprising:

a regulating member provided upstream of said sheet stacking portion with respect to the sheet conveying direction for regulating the sheet stacked on said sheet stacking portion in the sheet conveying direction; and a controlling portion, which controls said sheet conveying device to thereby cause the sheet to abut against said regulating member by the reverse rotation of said sheet conveying device, and controls said moving device to thereby move said sheet conveying device in the width direction integrally with the sheet so that the sheet abuts against said side edge regulating member, thereby aligning the sheet.

11. A sheet processing apparatus according to claim 8, wherein a contact position of said sheet conveying device contacting with the sheet is separated by a predetermined distance from the side edge of the sheet.

12. A sheet processing apparatus according to claim 11, wherein when the sheet is conveyed with the side edge of the sheet as a reference, the predetermined distance is the same irrespective of a size of the sheet.

13. A sheet processing apparatus according to claim 11, wherein the predetermined distance includes an amount of slip by which said sheet conveying device slips on the sheet while said sheet conveying device moves the sheet to said side edge regulating member.

14. A sheet processing apparatus according to claim 8, wherein when a distance between said side edge regulating member and the side edge of the sheet differs in accordance with a size of the sheet, a contact position of said sheet conveying device contacting with the sheet is more separated from said side edge regulating member as the distance is greater.

15. A sheet processing apparatus according to claim 7, further comprising a stapler, which staples a sheet bundle stacked on said sheet stacking portion.

16. An image forming apparatus comprising:

an image forming portion, which forms an image on a sheet; and a sheet processing apparatus, which processes the sheet having the image formed thereon by said image forming portion, wherein said sheet processing apparatus includes:

a sheet stacking portion, which stacks thereon the sheet conveyed from said image forming portion;

a side edge regulating member provided on a side of said sheet stacking portion in a width direction intersecting with a sheet conveying direction for regulating the sheet stacked on said sheet stacking portion in the width direction;

sheet moving means for moving the sheet stacked on said sheet stacking portion in the width direction so that the sheet abuts against said side edge regulating member; and pressing means for pressing a side edge portion of the sheet abutting against said side edge regulating member against said sheet stacking portion, said pressing means being provided near said side edge regulating member for movement toward and away from said sheet stacking portion, and said pressing means having guide means for guiding the side edge portion of the sheet moved between said pressing means and said sheet stacking portion by said sheet moving means.

* * * * *

UNITED STATES PATENT AND TRADEMARK OFFICE

CERTIFICATE OF CORRECTION

PATENT NO. : 7,300,046 B2
APPLICATION NO. : 11/103589
DATED : November 27, 2007
INVENTOR(S) : Sugiyama et al.

It is certified that error appears in the above-identified patent and that said Letters Patent is hereby corrected as shown below:

ON THE TITLE PAGE:
Page 2, Col. 2, under Item (56), References Cited, Foreign Patent Documents, "JP 2003081517 3/2003" should read --JP 2003-81517 3/2003--.

COLUMN 17:
Line 63, "41.6," should read --416,--.

Signed and Sealed this

Fifteenth Day of July, 2008

JON W. DUDAS
*Director of the United States Patent and Trademark Office*